US009693922B2

(12) United States Patent
Andersson et al.

(10) Patent No.: US 9,693,922 B2
(45) Date of Patent: Jul. 4, 2017

(54) SLING BAR OR LIFT STRAP CONNECTOR HAVING AN INTEGRATED SCALE WITH TILT COMPENSATION

(71) Applicant: Liko Research & Development AB, Lulea (SE)

(72) Inventors: Mattias Andersson, Soedra Sunderbyn (SE); Nils Anders Joakim Eriksson, Lulea (SE); Jean-Bernard Duvert, Auray (SE); Philippe Kaikenger, Pluvigner (SE)

(73) Assignee: Liko Research & Development AB, Lulea (SE)

( * ) Notice: Subject to any disclaimer, the term of this patent is extended or adjusted under 35 U.S.C. 154(b) by 121 days.

(21) Appl. No.: 14/518,706

(22) Filed: Oct. 20, 2014

(65) Prior Publication Data

US 2015/0107020 A1 Apr. 23, 2015

Related U.S. Application Data

(60) Provisional application No. 61/893,636, filed on Oct. 21, 2013.

(51) Int. Cl.
*A61G 7/10* (2006.01)

(52) U.S. Cl.
CPC ..... *A61G 7/1044* (2013.01); *A61G 7/108* (2013.01); *A61G 7/1015* (2013.01); *A61G 7/1042* (2013.01); *A61G 7/1046* (2013.01); *A61G 7/1051* (2013.01); *A61G 7/1059* (2013.01); *A61G 7/1061* (2013.01)

(58) Field of Classification Search
CPC .. A61G 7/1044; A61G 7/1059; A61G 7/1015; A61G 7/1042; A61G 7/1061; A61G 7/1051; A61G 7/108; A61G 7/1046; A61G 7/1069
See application file for complete search history.

(56) References Cited

U.S. PATENT DOCUMENTS 4,243,147 A 1/1981 Twitchell et al.
5,359,902 A * 11/1994 Barger ..... G01L 1/14 73/779
5,708,993 A 1/1998 Campbell et al.
(Continued)

OTHER PUBLICATIONS

European Search Report dated Mar. 19, 2015.

*Primary Examiner* — Nicholas Polito
*Assistant Examiner* — Myles Throop
(74) *Attorney, Agent, or Firm* — Schiff Hardin LLP

(57) ABSTRACT

Disclosed is a patient lift system having a sling bar with an inductively charged integrated scale. The lift system comprises a lift apparatus, a lift strap connected at a first end to the lift apparatus, a sling bar connected to a second free hanging end of the lift strap, the sling bar having a scale with a tension load cell integrally disposed therein for measuring forces applied thereto and a power source electrically connected to the scale to provide power to the scale and load cell. An accelerometer is disposed within the sling bar to determine a tilt angle of a lift axis of the load cell relative to a vertical direction of gravitational force. Programming stored in a processor of the integrated scale calculates an accurate weight of an active load suspended from the sling bar, based on the determined tilt angle and the measured force on the load cell.

16 Claims, 14 Drawing Sheets

(56) References Cited

U.S. PATENT DOCUMENTS

| | | | | |
|---|---|---|---|---|
| 5,809,591 | A * | 9/1998 | Capaldi | A61G 7/1015 5/83.1 |
| 6,329,612 | B1 * | 12/2001 | von Schroeter | A61G 7/1019 177/144 |
| 2005/0268401 | A1 * | 12/2005 | Dixon | A61B 5/1115 5/655.3 |
| 2006/0277683 | A1 * | 12/2006 | Lamire | A61G 7/005 5/600 |
| 2012/0117730 | A1 * | 5/2012 | Lemire | A61G 1/0268 5/611 |
| 2013/0019401 | A1 * | 1/2013 | Faucher | A61G 7/1015 5/85.1 |
| 2013/0319775 | A1 * | 12/2013 | Ngoh | A61G 7/108 177/1 |
| 2014/0013503 | A1 * | 1/2014 | Dixon | A61G 7/1073 5/85.1 |
| 2014/0210223 | A1 * | 7/2014 | Lamela | A61G 7/1061 294/81.5 |

* cited by examiner 20
18
16
10
33
14
22
12
235 lbs
24
25
26
28
28
32
30

162
160
164
154
166
168
172
170
156
152
150
158
158
176
174

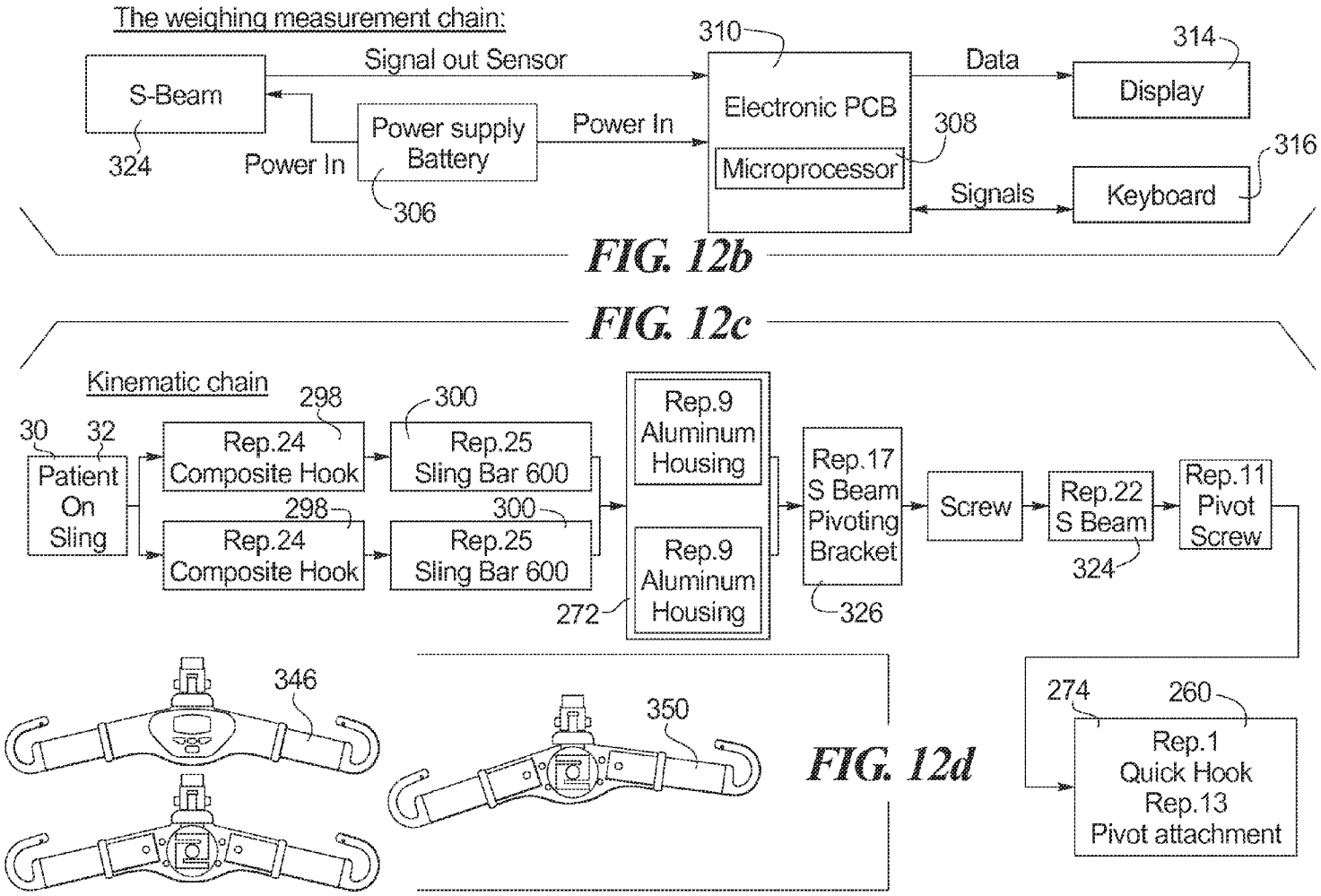
The weighing measurement chain:
S-Beam
324
Signal out Sensor
Power In
Power supply Battery
306
Power In
310
Electronic PCB
Microprocessor
308
Data
Signals
314
Display
316
Keyboard
FIG. 12b
Kinematic chain
30
Patient On Sling
32
298
Rep.24 Composite Hook
298
Rep.24 Composite Hook
300
Rep.25 Sling Bar 600
300
Rep.25 Sling Bar 600
272
Rep.9 Aluminum Housing
Rep.9 Aluminum Housing
Rep.17 S Beam Pivoting Bracket
326
Screw
Rep.22 S Beam
324
Rep.11 Pivot Screw
FIG. 12c
274
260
Rep.1 Quick Hook Rep.13 Pivot attachment
FIG. 12d
346
350

SLING BAR OR LIFT STRAP CONNECTOR HAVING AN INTEGRATED SCALE WITH TILT COMPENSATION

CROSS-REFERENCE TO RELATED APPLICATION

This application claims the benefit of U.S. Provisional Patent Application Ser. No. 61/893,636, filed Oct. 21, 2013, which is incorporated herein by reference.

FIELD

This disclosure relates generally to a lift system for patients, and more particularly to an overhead patient lift system including a lift scale.

BACKGROUND

Ceiling mounted overhead patient lift systems typically operate like a winch and usually include a housing or frame affixed to a rail in the ceiling, a lift motor installed within the housing, a cylindrical lift drum inside the housing and driven by the lift motor, and a lift strap affixed at one end within the lift drum for lifting or lowering a patient when the drum is rotated and the strap is respectfully either wound up on the lift drum or paid out from the lift drum. A portable patient lift typically operates like a pneumatic hoist having a lift arm connected to one or more pneumatic (or hydraulic) cylinders for lifting or lowering a patient. Such lifts are known for use in connection with the lifting of patients for any number of reasons. One such reason is for weighing patients that are not capable of standing by themselves on a scale, as with patients confined to wheelchairs, or bariatric patients who have had weight loss surgery.

There are several known ways of weighing a patient using an overhead lift, one of which is to install a portable in-line tension scale between the sling bar and either (1) the lift strap of a motorized ceiling lift or portable patient lift, or (2) the lifting end of the lift arm of a portable patient lift. One such in-line scale is the LikoScale 350 sold by Liko AB. The in-line scale is connected at its top end to either the free hanging end of the lift strap in a ceiling mounted lift or portable lift, or the lift end of the rigid lift arm of a portable patient lift. Then the sling bar is connected to the lower end of the in-line scale. When a load is lifted by either lift, the in-line scale is placed in tension, and thus measures the patient's weight.

However, there are several drawbacks to such an in-line scale. First, utilizing an in-line scale reduces the lift height available to fully lift a patient off the ground or out of a chair or bed by as much as 8 inches, due to the length of the in-line scale. Depending on the height of the ceiling in a patient room, which in many hospitals may be fairly low, this reduced lift height may prevent a patient seated in a patient sling below the sling bar from being fully lifted off a bed, chair, or other support and otherwise make it difficult to accurately measure the patient's weight.

Second, in-line scales are powered by traditional batteries, which eventually become discharged and need to be replaced. When the scales lose power, the batteries must be replaced, but an operator may not have replacement batteries on hand or even nearby. Utilizing rechargeable batteries in the scale would still require that either they periodically be removed for recharging in a separate charger, or that the entire scale be removed from the lift and plugged into a wall outlet for recharging. In addition, periodically plugging the entire scale into a wall outlet will typically mean the scale would need to be removed from the patient lift, which can be time consuming each time the scale is installed and removed from the patient lift.

Accordingly, there is a need for a device with which to measure the weight of a patient using a patient lift, without reducing the available lift height of the patient lift, or at least minimizing the reduction in the available lift height of the patient lift. Further, there is a need for a device with which to measure a patient's weight using a patient lift, while eliminating any electrical connection between an external power supply and either of (1) the direct electrical inputs for powering the patient scale, or (2) the terminals of rechargeable batteries that may provide power to the patient scale. Still further, there is a need for a battery powered patient weighing device whose batteries can periodically be recharged before they lose power and without having to either remove them from the device or remove the device from the patient lift.

One solution to the aforementioned issues, as will be disclosed herein below, is to utilize a sling bar with an integrated scale, eliminating the need for a separate in-line scale to be connected thereto. However, one additional issue may arise with this proposed solution, in that if the active load suspended from the sling bar is not properly balanced or centered below the sling bar, the unbalanced weight may cause the sling bar, and accordingly the load cell of the scale integrated therein, to tilt at an angle from its normal balanced position. This means that a load axis of the load cell would become tilted or angled at some angle to the vertical direction of gravitational force, resulting in errors in the accuracy of any measurements taken by the load cell while in that position. This would ultimately result in inaccurate weight measurements. Accordingly, there is also a need for a way to compensate for any tilting of the sling bar that occurs during active loading, which tilting might otherwise angle the load axis of the load cell out of alignment with the vertical direction of gravitational force and affect the accuracy of weight measurements taken by the load cell of the scale.

BRIEF DESCRIPTION OF THE DRAWINGS

The present invention is described in detail below with reference to the attached drawing figures, wherein:

FIG. 12*b* is a block diagram of a measurement chain of the sling bar of FIG. 12*a*.

FIG. 12*c* is a block diagram of a kinematic chain of the sling bar of FIG. 12*a*.

FIG. 12*d* is a schematic representation of the sling bar of FIG. 12*a* showing tilt compensation.

DETAILED DESCRIPTION

Figure 1:
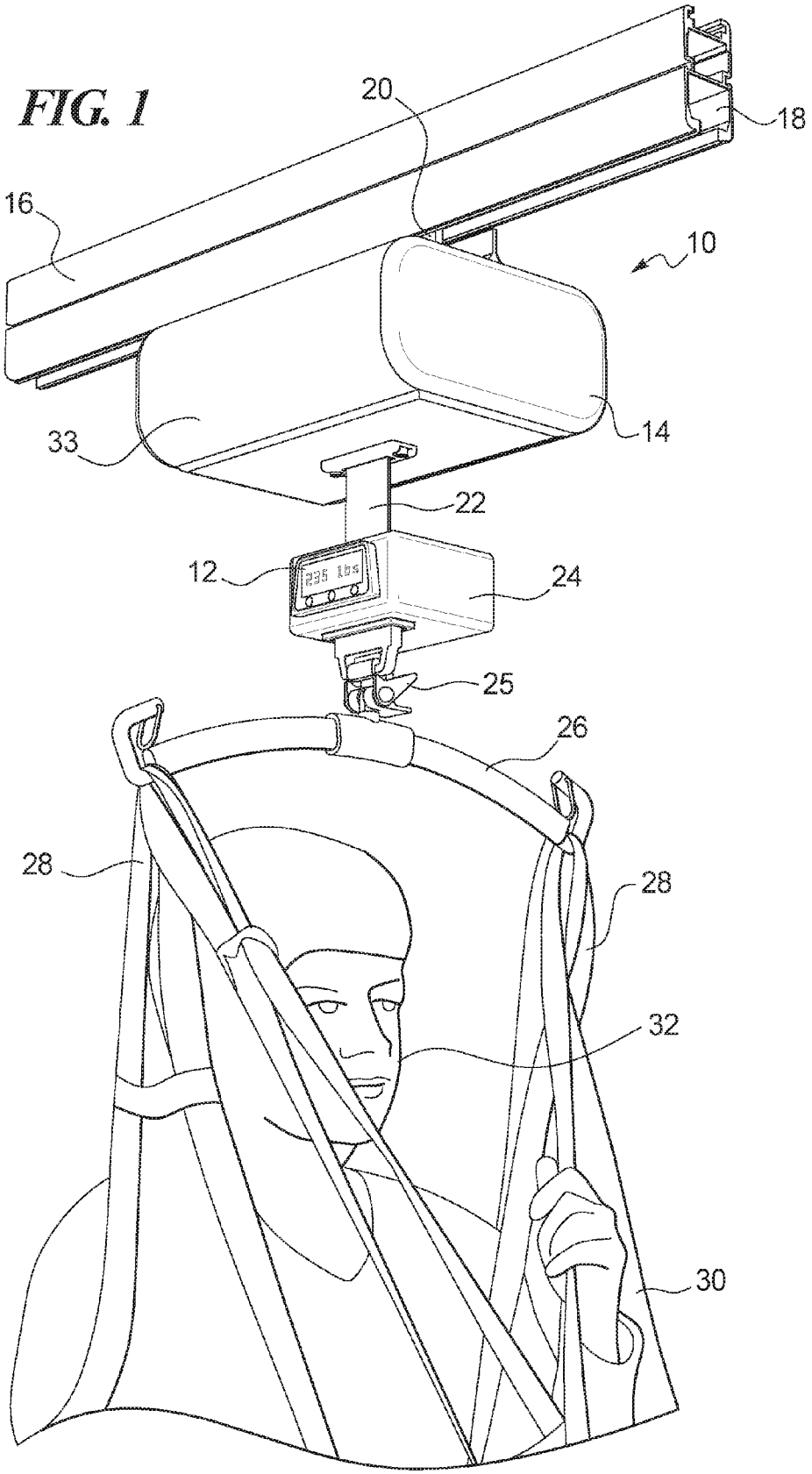
FIG. 1 is a partial perspective view of a patient seated in a lift sling and suspended from an embodiment of a patient lift system utilizing a quick-release link with an integrated scale disposed therein, as disclosed herein.

Referring first to FIG. 1, an embodiment of a patient lift system 10 having an integrated scale 12 is provided. In the illustrated embodiment, the lift system 10 includes an overhead lift apparatus 14 affixed to a ceiling of a room or other overhead structure. In the illustrated example, the ceiling of the room includes a beam 16 to which the lift apparatus 14 is affixed. The beam 16 may include an extrusion having a channel 18 within which is provided sliding element 20 that is movable along the channel 18 and that extends out of the channel to support the lift apparatus. The beam 16 is affixed to and supported by structural elements of the building or other structure in which the beam is located. The beam 16 may form part of the building or may be added or affixed to components of the building. Other means for supporting the lift apparatus from the ceiling may be provided and are within the scope of this invention.

A lift strap 22 is connected at a first end to the lift apparatus 14 and configured to be taken up or paid out from the overhead lift apparatus 14. A quick-release link 24, also referred to as a "Q-link" or connector link, is coupled to a free second end of the lift strap 22, and a removable sling bar 26 is coupled to the quick-release link 24 by a fastener 25. In certain embodiments, the quick-release link 24 includes an integrated weight scale 12 disposed therein for measuring the weight of a load, such as a patient or other active load, suspended from the sling bar 26, or from any component affixed to the quick-release link 24. In an alternate embodiment as will be described hereinafter, the sling bar 26 (rather than the quick-release link 24) includes an integrated weight scale disposed therein for measuring the weight of a load, such as an active load, suspended from the sling bar.

In FIG. 1, the sling bar 26 is affixed to straps 28 of a sling 30 that is supporting a patient 32. The patient's weight is born by the sling bar 26 as a result of the sling 30 being suspended below the sling bar 26. Other devices for supporting a patient or other load are possible and within the scope of the present invention.

In certain embodiments, as will be understood by those of skill in this art, the overhead lift apparatus 14 includes a frame (not shown) that is affixed to the beam 16 or ceiling or other supporting structure by the sliding element 20 or other structure. A housing 33 covers the frame of the lift apparatus and a lift motor (not shown) is affixed to the frame and disposed in the housing 33. A rotary lift drum (not shown) disposed within the housing 33 is connected so as to be driven by the lift motor. In such an embodiment, the lift strap 22 has a first end affixed to the lift drum. The lift drum is configured to wind up and pay out the lift strap 22 as the lift motor is operated. In certain embodiments, the frame may be connected to a wheeled carriage which comprises the sliding element 20 that is configured to ride within the beam or rail 16 that is affixed to or forms part of the ceiling. Alternatively, the frame of the lift apparatus 14 may be directly mounted to a fixed point in the ceiling.

Figure 2:
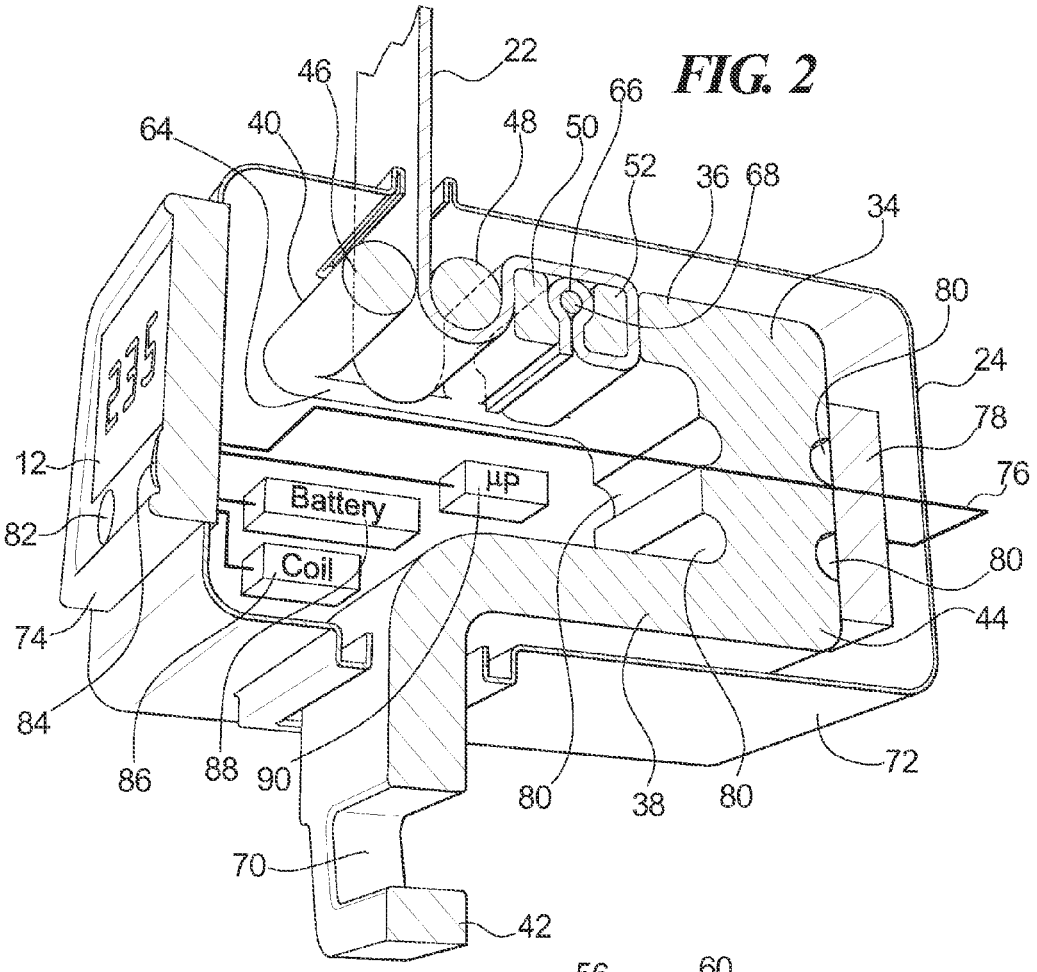
FIG. 2 is a cross-section perspective view of an embodiment of a quick-release link with an integrated scale, as disclosed herein.

Turning to FIG. 2, the scale portion 12 of the quick release link 24 is shown in cross section. In the illustrated embodiment, the quick-release link 24 is affixed to the free hanging end of the lift strap 22 has an integrated scale 12 incorporated therein. In the illustrated embodiment, the quick-release link 24 comprises a powered integrated scale 12 having a load cell 34 with opposite first and second ends 36 and 38 upon which opposing forces act to register the measurement of weight in the load cell 34. The quick-release link 24 further comprises a slotted lift strap retention buckle 40 coupled to (or disposed at) the first end 36 of the load cell 34, and a D-ring 42 coupled to (or disposed at) the second end 38 of the load cell 34. While the disclosure described above discloses a D-ring 42 coupled to, disposed at, or formed in an end of the load cell 34, in alternate embodiments, the D-ring may be a square ring, round ring, partially closed ring, or any other geometry that is capable of mating to a complementary component and functioning as a load bearing connection, without departing from the scope of the present disclosure.

The slotted retention buckle 40 and D-ring 42 may be integrally formed in the ends of the load cell 34 or may be mated to complementary connection structures disposed at the respective first and second ends of the load cell 34. The quick-release link 34 is configured to permit the lift strap 22 that is coupled to the slotted retention buckle 40 and the D-ring 42 to be substantially aligned (or co-planar) with each other when the load cell 34 is placed under an active load, such as when a patient is seated in the lift sling 30 connected to the sling bar 26 that is suspended by the D-ring 42.

In one embodiment, the load cell 34 of the quick-release link 24 is C-shaped, with an upper leg or end 36 of the C-shape load cell 34 being configured as, or coupled to, a slotted lift strap retention buckle 40, while the lower leg or end 38 of the C-shaped load cell 34 is configured as or coupled to a D-ring 42. In another embodiment, the slotted lift strap retention buckle 40 and the D-ring 42 may be integrally formed in the respective upper and lower legs 36 and 38, without departing from the scope of the present disclosure. The active load sensing area 44 of the load cell is the portion of the C-shape connected between the upper and lower legs 36 and 38 of the load cell 34. Such a C-shaped load cell 34 is actively placed under load by applying a tensile force to the end of each leg 36 and 38 of the load cell 34 so that the force acts, in the illustrated embodiment, perpendicular to the length of each leg 36 and 38, and in opposing directions to one another. The forces acting on each leg 36 and 38 are collinear with each other and in opposite directions. With such a configuration, the load cell 34 may occupy a shorter vertical height than a comparable linear load cell in which the points on which forces are applied are collinear with the load cell. Such a C-shaped load cell 34 also places the load sensing portion 44 to the side of, in front of, or behind the location on which the active load is applied through the D-ring 42 and the slotted buckle 40.

Figure 3:
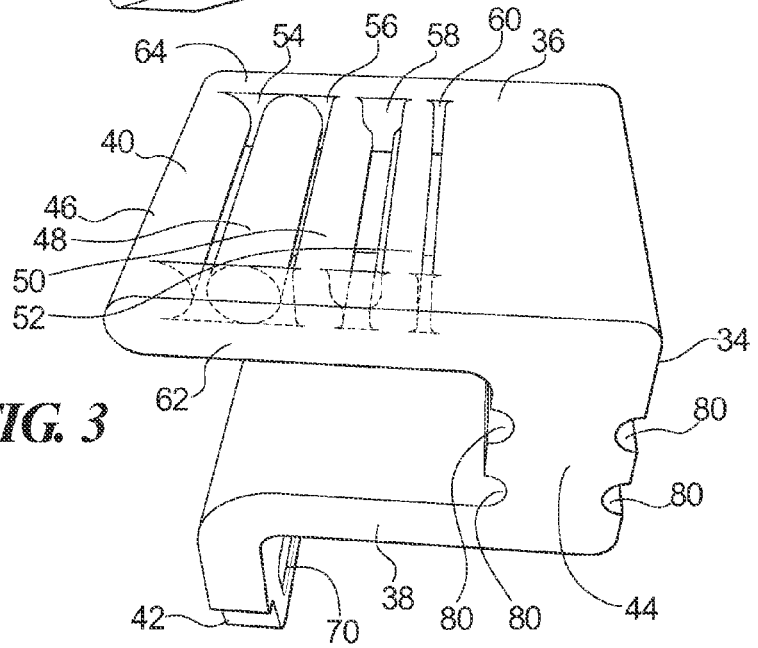
FIG. 3 is a top, side perspective view of a quick release link with an integrated scale, as disclosed herein.

The slotted lift strap retention buckle 40, as seen in FIGS. 2 and 3, comprises a series of parallel members 46, 48, 50 and 52 spaced apart from one another to form slots 54, 56, 58, and 60 (see FIG. 3). The parallel members 46, 48, 50 and 52 are affixed at their ends to a common front member 62 and a common back member 64. A loop 66 of lift strap material 22 is formed at a free end thereof and a retention pin 68 is inserted into the loop 66 of strap material 22. The slots 54, 56, 58, and 60 between the parallel members 46, 48, 50 and 52 of the strap retention buckle 40 are wide enough to permit the lift strap 22 to be wound around and between any two adjacent parallel members 46, 48, 50 and 52, but not wide enough to permit the retention pin 68 and end of the lift strap 22 from being pulled through the slots 54, 56, 58, and 60. Accordingly, the lift strap 22 is wound around and between the parallel members 46, 48, 50 and 52, which provide a frictional resistance to pulling forces placed on the lift strap 22, with the retention pin 68 at the end of the lift strap 22 providing an interference fit between two parallel members 50 and 52 that prevents the end of the lift strap 22 from being pulled out of the slotted retention buckle 40. In particular, the parallel members 50 and 52 are shaped to provide a wider spacing at a top which permits the loop 66 and retention pin 68 to fit into the space between the parallel members 50 and 52, and a narrower spacing at the bottom that prevents the loop 66 and retention pin 68 from pulling through the slot 58. The parallel members 50 and 52 have curved surfaces directed toward one another to accommodate the loop 66 and retention pin 68 in tight engagement, thereby ensuring that the strap 22 does not slip out. The winding of the lift strap 22 through the slots 54, 56, 58, and 60, along with the retention pin 68 having an interference fit with the parallel members 46, 48, 50 and 52, provides the connection between the lift strap 22 and the load cell 34 of the quick-release link 24. However, in alternate embodiments, other or additional methods and structures of retaining the lift strap 22 in the quick-release link 24 may be utilized without departing from the scope of the present disclosure, such as for example, mechanical clamps that clamp onto the outer surfaces of the lift strap, pins/posts that mate into eyelets disposed in the lift strap, or other such methods or devices.

The D-ring 42 extends downward from and perpendicular to the lower leg 38 of the C-shaped load cell 34 to which it is coupled. In one embodiment, the D-ring 42 is a flat plate of structural load bearing material having an elongated through slot 70 disposed therein so as to form a ring onto which the quick-release hook or fastener 25 of a sling bar 26 may be clipped or otherwise fastened.

The quick-release link 24 and its components may optionally be surrounded by an outer housing 72 as shown in FIG. 2. In one embodiment, the quick-release link 24 may include a powered display 74 disposed in a side of the housing 72, which display 74 is in communication with the load cell 34 via an electrical connection 76 that connects to a sensor 78, such as a strain gauge or other strain sensor. The strain gauge sensor 78 is mounted on the load sensing area 44 of the load cell 34 to sense changes in flexure or strain on the load sensing area 44 as a result of a load being suspended from the load cell 34. As shown in the drawings, the load sensing area 44 is provided with horizontally extending half cylindrical shaped cut-outs 80 on the inside and outside surfaces and the strain gauge sensor 78 is mounted on the outside surface over the cut-outs 80. The strain gauge sensor 78 may be mounted to the inside surface instead, or sensors may be mounted to the inside and outside surfaces for determining a difference in flexure.

The display 74 is configured to display the weight of an active load suspended from the D-ring 42. The scale 12 additionally includes a power button 82 for turning the scale 12 off and on, as well as a "zero" or "tare" button 84 for resetting or zeroing out the load cell 34 of the scale. In certain embodiments, the display 74 may be in communication with the load cell 34, either by wired or wireless connection, such as by standard wireless technologies like Wi-Fi or Bluetooth. In another embodiment, the load cell 34 and/or the display 74 may transmit, either by wired or wireless communication methods, the measured weight information to a terminal or other receiver or to a handheld controller of the lift system, or directly to an electronic medical record (EMR) for the patient being weighed.

The load cell 34 and optional display 74 are powered by a power supply, such as by a standard disposable battery or a rechargeable battery 88, by a power cord connected to an electrical outlet, by one or more thin or flexible wires connected to a power source, or by any other wired or wireless electrical connection to a power supply. In embodiments in which the load cell 34 and display 74 are powered by a rechargeable battery 88, optionally disposed within the quick-release link housing 72 may be an inductive charging coil 86 that is in electrical communication with the battery powered load cell and display 74. The inductive charging coil 86 is configured to inductively charge the rechargeable battery 88 that powers the load cell 34 and the integrated scale 12. The inductive charging occurs when the quick-release link 24 is raised adjacent to the lift apparatus 14, which also has an inductive coil, so that the inductive charging coil 86 in the quick-release link 24 is positioned within the electromagnetic field of the inductive charging station disposed in or near the lift apparatus.

In certain embodiments, the scale 12 includes a processor 90 and integrated program code capable of taking the tension or compression output signal from the strain gauge 78 on the load cell 34 and calculating the weight of the tensile load that is being applied thereto. The processor 90 then displays the calculated weight on one or more output displays. In the illustrated embodiment, the strain gauge 78 is mounted on the outer surface of the load cell and senses compression as the load cell flexes in response to the weight of a load. A strain sensor may be mounted on the inside surface of the C-shaped load cell to sense expansion of the surface of the load cell, for example using a tensile load cell. In alternate embodiments, sensors may be mounted on both surfaces or alternative load cell types, such as compression strain gauges or tension/compression load cells, may be used with the same or different embodiments of a quick-release link without departing from the scope of the present disclosure. In addition, alternate load cell programming setups and configurations may be utilized herein without departing from the scope of the present disclosure.

In FIG. 1, certain embodiments of the overhead patient lift system 10 may optionally include an inductive charging station disposed in the overhead lift apparatus 14 that inductively couples to the coil 86 in the quick-release link 24 when the two parts are in proximity to one another. Electrical power is provided to the lift apparatus 14 for the motor, for example, by connection to an electrical outline or other source of line power. The electrical power is also provided to the inductive charging station. The inductive charging station in the lift apparatus 14 provides power to the integrated weight scale 12 disposed in the quick-release link 24 to inductively recharge the battery 88 or other power supply disposed connected to the scale 12. The lift system 10 may also optionally include a remote control unit for inputting controls to the lift apparatus 14 to take up or pay out the lift strap 22, and an output display disposed in one or more of the remote control unit or either of the respective quick-release link 24 or sling bar 26 (whichever contains the integrated scale) for displaying weight measurements received from the integrated scale.

Figure 4:
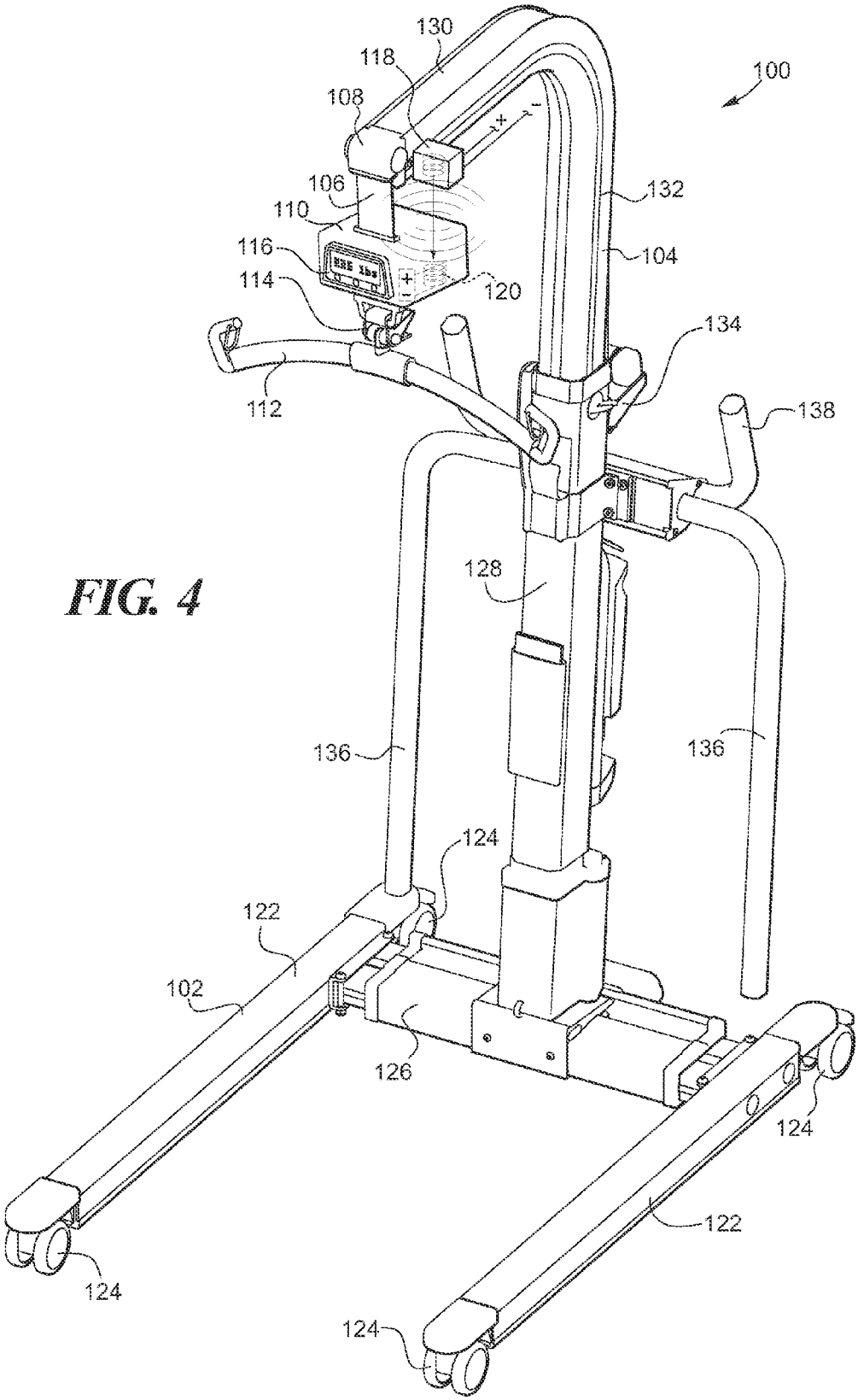
FIG. 4 is a top, front perspective view of an embodiment of a portable patient lift utilizing a quick-release link having an integrated scale disposed therein, as disclosed herein.

Referring to FIG. 4, an alternate embodiment of the lift system of the present disclosure may be a portable patient lift system 100 similar to that of the overhead patient lift system 10, without departing from the scope of the present disclosure. The portable patient lift system 100 may comprise a portable patient lift apparatus having a moveable base 102, a lift or support arm 104 connected to the moveable base 102 and extending outward therefrom, a lift strap 106 connected at a first end 108 to the portable lift apparatus 100 and extending from the lift or support arm 104 and configured to be taken up or paid out from the end of the lift arm 104, a quick-release link (or Q-link or connector link) 110 coupled to a free second end of the lift strap 106, and a removable sling bar 112 coupled to the quick-release link 110 by a quick-release hook 114 of the removable sling bar 112. In one embodiment, the quick-release link 110 includes an integrated weight scale 116 disposed therein for measuring the weight of active loads suspended from the sling bar 112 or quick-release link 110. In an alternate embodiment that is described herein, the sling bar, rather than the quick-release link, includes an integrated weight scale disposed therein for measuring the weight of active loads suspended from the sling bar.

An embodiment of the portable patient lift system 100 may optionally comprise the lift arm 104 having an inductive charging station 118 disposed at an end 108 thereof, with the integrated weight scale 116 disposed in either of the respective quick-release link 110 or sling bar 112 having an inductively rechargeable power supply 120 disposed therein. The inductive charging station 118 includes an inductive coupling coil disposed within a small housing mounted adjacent the first end 108 of the support arm 104. The inductive charging station 118 is connected to electrical power, such as line power via a power cord for connecting into a wall or floor outlet, or battery power such as from a storage battery provided in the portable patient lift system 100. Electrical power is inductively transferred from the power station 118 to the quick release link 110 for powering the scale 116, or more precisely for charging a storage battery that in turn supplies power to the circuits of the scale 116. The inductive coupling of power between the charging station 118 and the scale 116 is possible when the two elements are in close proximity to one another such as when the strap 106 is retracted. The storage battery provides power to the scale 116 when the strap 106 is extended and the scale is out of range of the inductive charging station 118. The scale 116 is thereby provided with power for supply to the processor, circuits, sensor and display without requiring connection of the scale to a wired external power source and without the need for replacing discharged batteries.

The lift system may also optionally include a remote control unit for inputting controls to the portable lift apparatus to take up or pay out the lift strap, and an output display disposed in the remote control unit or either of the respective quick-release link or sling bar (whichever contains the integrated scale) for displaying weight measurements received from the integrated scale.

In FIG. 4, the lift apparatus of the portable patient lift system 100 includes the mobile base 102 with two parallel legs 122 that each have rollers 124 at each end. The legs 122 are connected to one another by a transverse member 126 adjacent one end of the legs 122 to as to provide a stable base below the sling bar 112 that can be positioned under a bed or chair, for example. As is apparent from the drawings, the transverse member is extendable and retractable to change the spacing between the legs 122 as needed. An upright frame 128 is connected to the transverse member 126 of the mobile base 102. The lift arm 104 includes a horizontal portion 130 that extends over the space between the parallel legs 122. The horizontal portion 130 and the vertical portion 132 of the lift arm 104 have the lift strap 106 extending along its length from the end 108 to a take up drum and motor 134. The lift strap 106 extending from the free end 108 of the lift arm 104 may be paid out or taken up from an end 108 of the lift arm 104 by operating the motor 134. In detail, the paying out or taking up of the lift strap 106 may be performed by a lift drum around which is wrapped an end of the lift strap 106, similar to that of the overhead lift apparatus described above, with the lift drum being rotated by a motor coupled thereto.

Instead of a motor to drive the lift strap drum, a manual ratcheting handle 136 may be provided to advance the drum and take up the lift strap or to reverse the drum pay out the strap to raise or lower the patient. A pair of long armed ratcheting handles 136 is provided for leverage, and a pair of shorter control handles 138 is also provided. Instead of or in addition to retracting and paying out the strap 106, the support arm 104 may be raised and lowered in the upright frame 128 either by manual operation using the handles 136 and 138 or by power to motors, hydraulic or pneumatic pumps, or other motive means. The support arm 104 may be fixed at a 90 degree angle or may be hinged and provided with an apparatus to lift the hinged portion. Other similar apparatuses configured to rotate the lift drum to take up or pay out the lift strap therefrom or to move the arm may be provided. In certain embodiments, the portable lift system 100 further includes one or more mechanisms for raising and lowering the lift arm, such as for example pneumatic or hydraulic cylinders, or other known technology for moving the lift arm when it is either unloaded or has active loads suspended therefrom. In one embodiment, the lift arm may include either pneumatic or hydraulic cylinders respectively fixed at a first and second end to each of the upright frame 128 and the lift arm 104, for raising and lowering the lift arm. The portable patient lift may further optionally include a rechargeable battery or power supply, equipment such as a motor or pump for actuating the one or more pneumatic or hydraulic cylinder, and a control panel for inputting command controls to the motor, pump, or cylinder.

Figure 5:
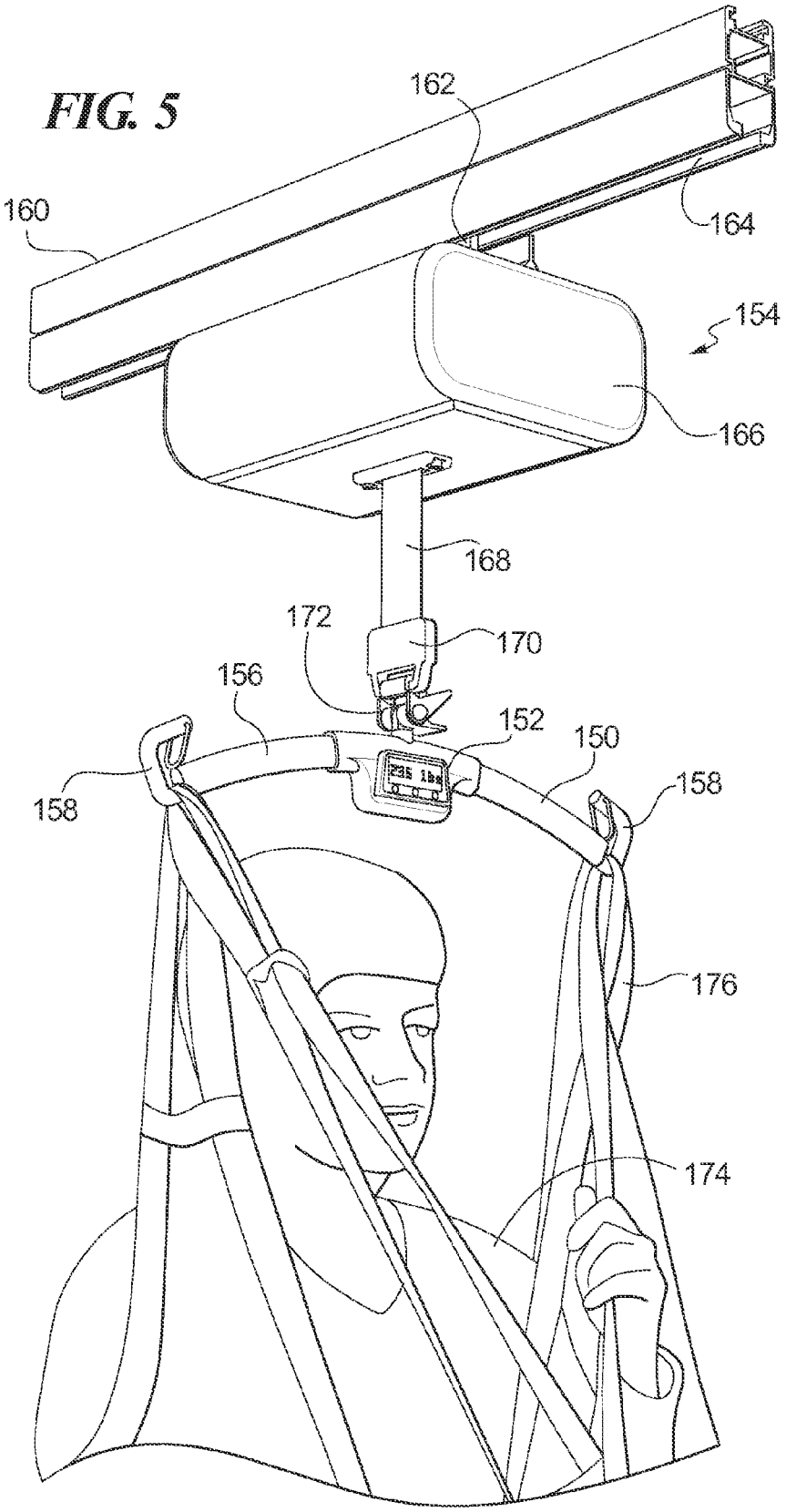
FIG. 5 is a partial perspective view of a patient seated in a lift sling and suspended from an embodiment of a patient lift system and sling bar with an inductively charged integrated scale, of the present disclosure.

FIG. 5 shows a sling bar 150 with an integrated scale 152 for a lifting apparatus 154. In the illustrated embodiment, the sling bar 150, rather than the quick-release link, may contain an integrated scale 152. In such embodiment, the sling bar 150 for use with a patient lift system 154 comprises a cross bar 156 (or a pair of arms), lift hooks 158 with safety latches disposed at and extending outward from each end of the cross bar 156 (or pair of arms), and the powered scale 152 disposed within the cross bar 156 and positioned at a center line of the length of the cross bar 156. The illustrated lifting apparatus 154 includes a beam 160 that may be provided on a structure, such as in a room or building, a sliding element 162 that is movable along a channel 164 in the beam 160 and a housing 166 that encloses a motor and drum for taking up and paying out a lift strap 168, on the end of which is a D-ring 170. A removable clip 172 on the sling bar 150 is removably engaged to the D-ring 170. The motor is connected to a control that a user utilizes to operate the motor to raise and lower the sling bar 150 by rotating the drum. A patient 174 is supported in a sling 176 that is connected to the sling bar 150.

A power supply is provided in electrical communication with the integrated scale 152. In various embodiments, the power supply may be any of a standard disposable battery, a rechargeable battery, a power cord connected to an electrical outlet, one or more thin or flexible wires connected to a power source, or any other wired or wireless electrical connection to a power supply. In embodiments in which the scale 152 is powered by a rechargeable battery, an inductive charging coil is provided in the scale 152 or electrically connected to it and a complimentary inductive coil of an inductive charging station is provided, for example, in a housing 166 of the lift apparatus. The inductive charging coil may optionally be disposed in or on the cross bar 156 or arms of the sling bar 150 and configured to inductively charge the rechargeable battery of the battery powered scale 152. Inductive recharging occurs when the sling bar 150 is raised adjacent to the lift apparatus housing 166 and the inductive coil is positioned within the electromagnetic field of one another for inductive transfer of power from the lift apparatus.

Figure 6:
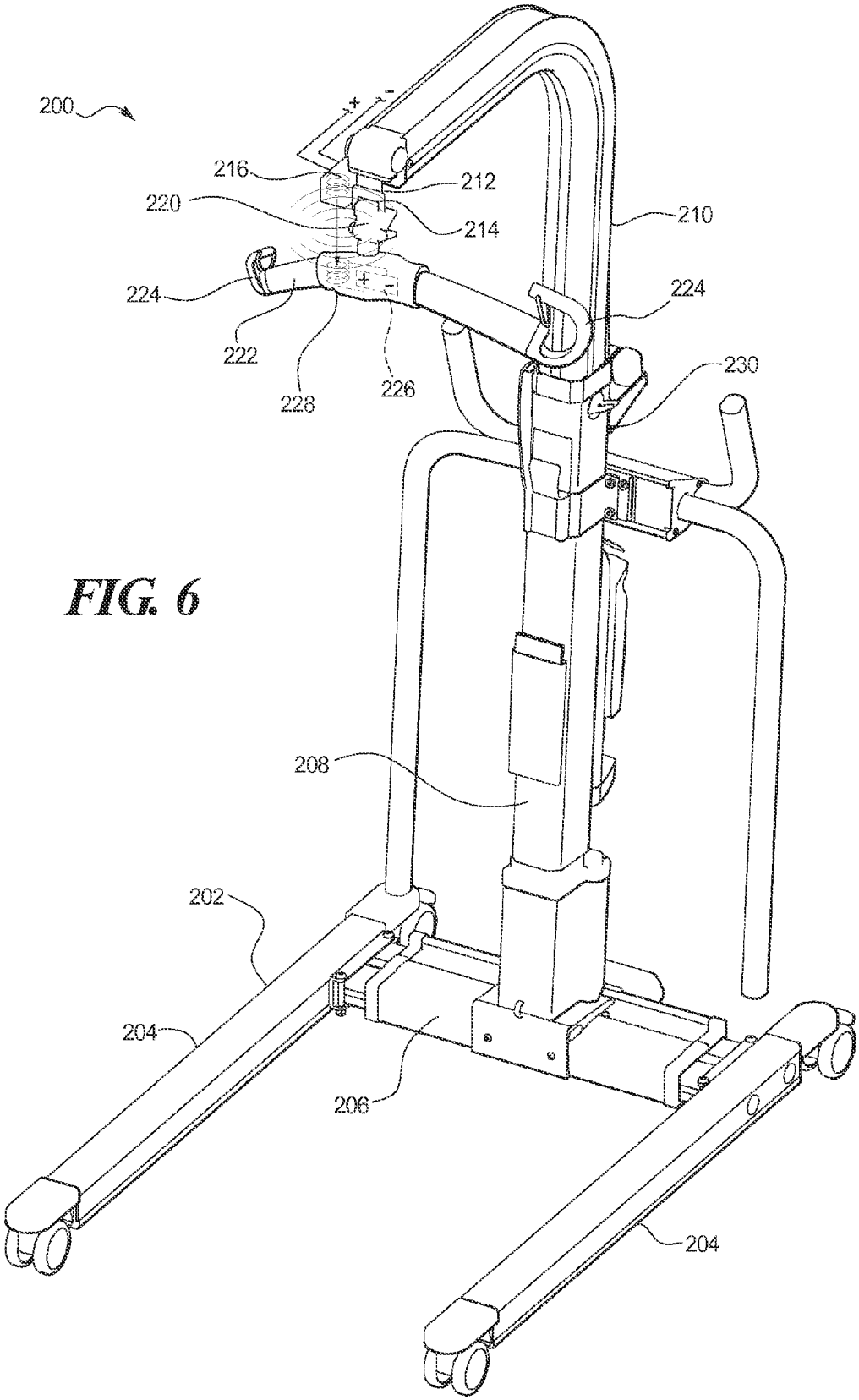
FIG. 6 is a top, front perspective view of an embodiment of a portable patient lift system and sling bar with an inductively charged integrated scale, of the present disclosure.

FIG. 6 shows an embodiment of the portable patient lift system 200 having a moveable base 202 with parallel legs 204, transverse member 206, upright frame 208, lift arm 210, lift strap 212, and D-ring 214. The portable lift system 200 includes an inductive charging station 216 at an end 218 of the lift arm 210. The inductive charging station 216 includes an inductive coil and is connected to electrical power, such as by a power cord and plug that may be connected to an electrical outlet or by a portable power supply such as a storage battery. The D-ring 214 is engaged by a removable clip 220 that is provided on a sling bar 222, the sling bar 222 having lift hooks 224 at its opposite ends. The sling bar 222 has an integrated scale 226 that provides weight information of the patient. The scale 226 is powered by a battery or other power storage, for example, that may be recharged by inductive power transfer from the inductive charging station 216 to an inductive coil 228 in the sling bar 222. The inductive charging of the battery in the sling bar 222 may occur when the sling bar 222 is in the raised position as shown in FIG. 6. The sling bar 222 may be lowered by extending the lift strap 212, such as by a manual or powered drum 230. The power storage for the scale 226 may be kept charged by the inductive transfer of power without requiring replacement of depleted batteries or a separate connection from the sling bar 222 to an electrical outlet, for example. The lift system of FIG. 6 shares many features with other embodiments shown herein and features descriptions for the other embodiments may be applicable here.

Figure 7:
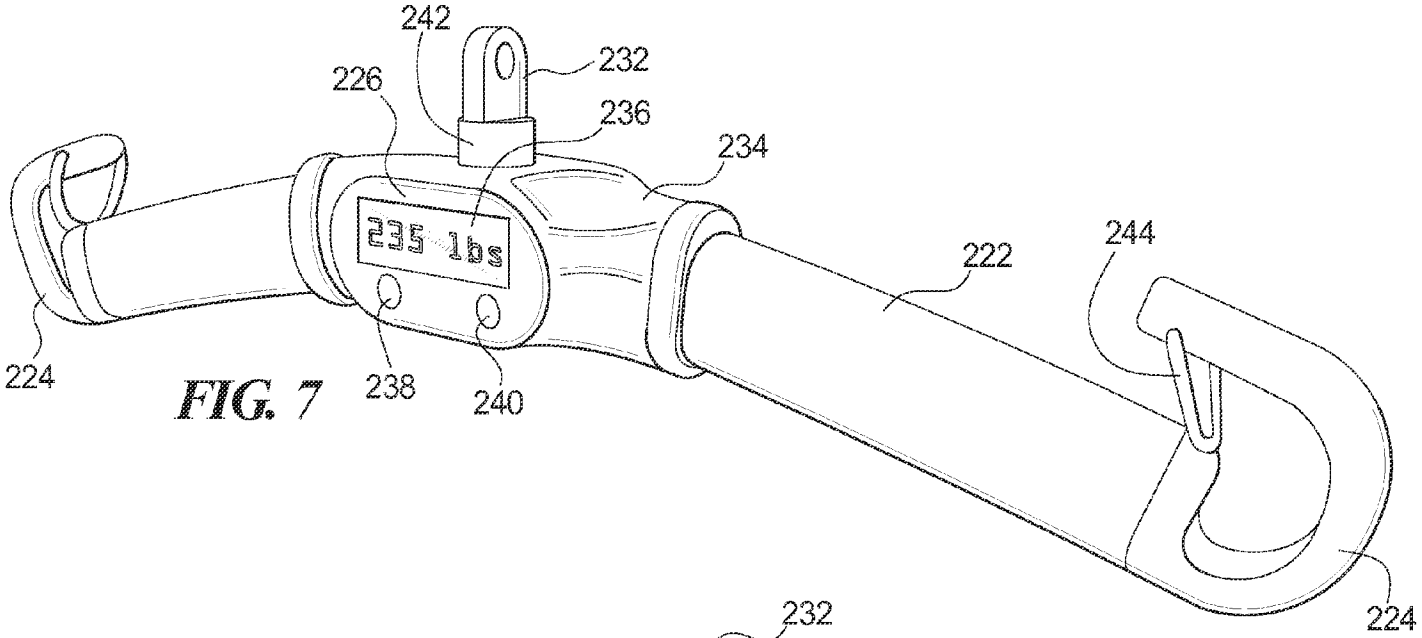
FIG. 7 is a perspective view of an embodiment of a sling bar with an inductively charged integrated scale of the present disclosure.

FIG. 7 shows an embodiment of the sling bar 222 that includes an integrated scale 226, such as might be used with either the lift systems of FIG. 5 or FIG. 6. The powered scale 226 includes a load cell integrally disposed within the cross bar or sling bar 222 and positioned at a center point of the length of the cross bar, directly below the sling bar's connection point or connector 232 for connecting to a quick-release link, a lift strap, or a lift arm of a lift apparatus. The connector 232 is movable relative to the sling bar 222 and is connected to a load cell that is disposed within a central housing 234.

The load cell is integrally disposed within the central housing 234. The load cell may be enclosed within the structure of either the cross bar or central housing and may include a bottom connector that is affixed to and disposed within an internal structure of the cross bar or central housing. The load cell further includes the top connector 232 disposed at the top end of the load cell that is not connected to the structure of the cross bar. Rather, the top connector 232 of the load cell is connected either directly to a free end of the lift strap or lift arm, or to intermediate connection hardware, such as a swivel connector, quick-release hook, or quick-release link, that will be connected to the free end of the lift strap or lift arm of a lift apparatus. The powered scale 226 further includes an output display 236 in communication with the load cell, for displaying the weight of an active tensile load placed on the load cell. The powered scale 226 additionally includes a power button 238 for turning the scale 226 off and on, as well as a "zero" or "tare" button 240 for resetting or zeroing out the load cell of the scale 226.

Figure 8:
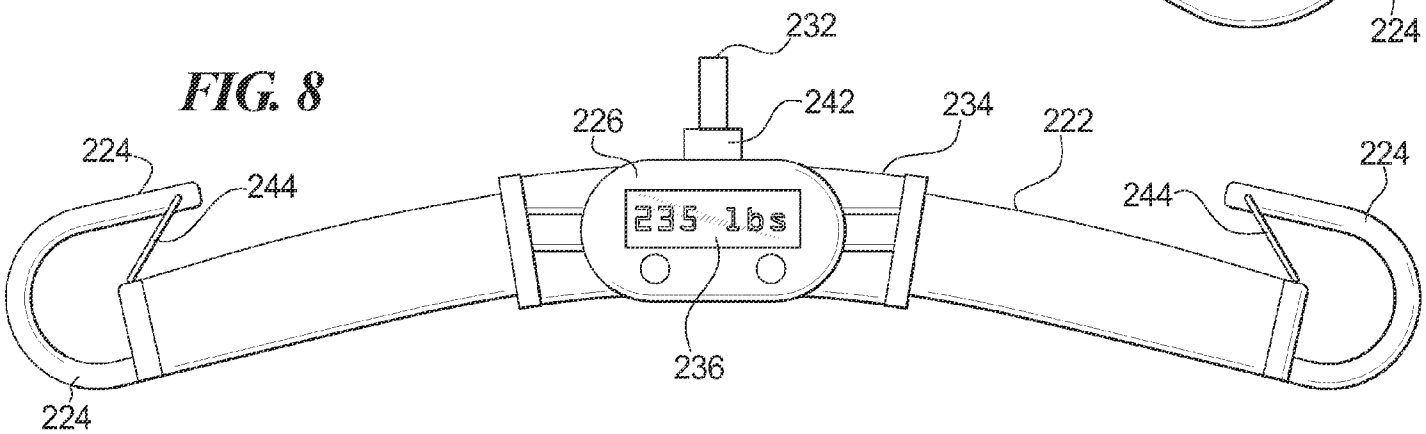
FIG. 8 is a front, elevational view of an embodiment of a sling bar with an inductively charged integrated scale of the present disclosure.

With reference to FIG. 8, the connector 232 is located at a center of the sling bar 222 to provide balanced lifting so long as the load is equal on both ends. The connector 232 is disposed in a collar 242. In certain embodiments, the connector 232 moves in the collar 242, whereas in other embodiments, the collar 242 moves relative to the housing 234 during sensing of the weight of the patient suspended from the sling bar 222. The display 236 is prominent for easy visibility and includes an indication of a unit of measure for the displayed weight. Certain embodiments permit the displayed units to be changed, for example between English units and metric units. The lift hooks 224 at each end of the sling bar 222 are configured for easy connection to loops of a sling as well as to prevent the sling loops from inadvertently slipping from the sling bar 222, for example, by the addition of safety clips 244.

Figure 9:
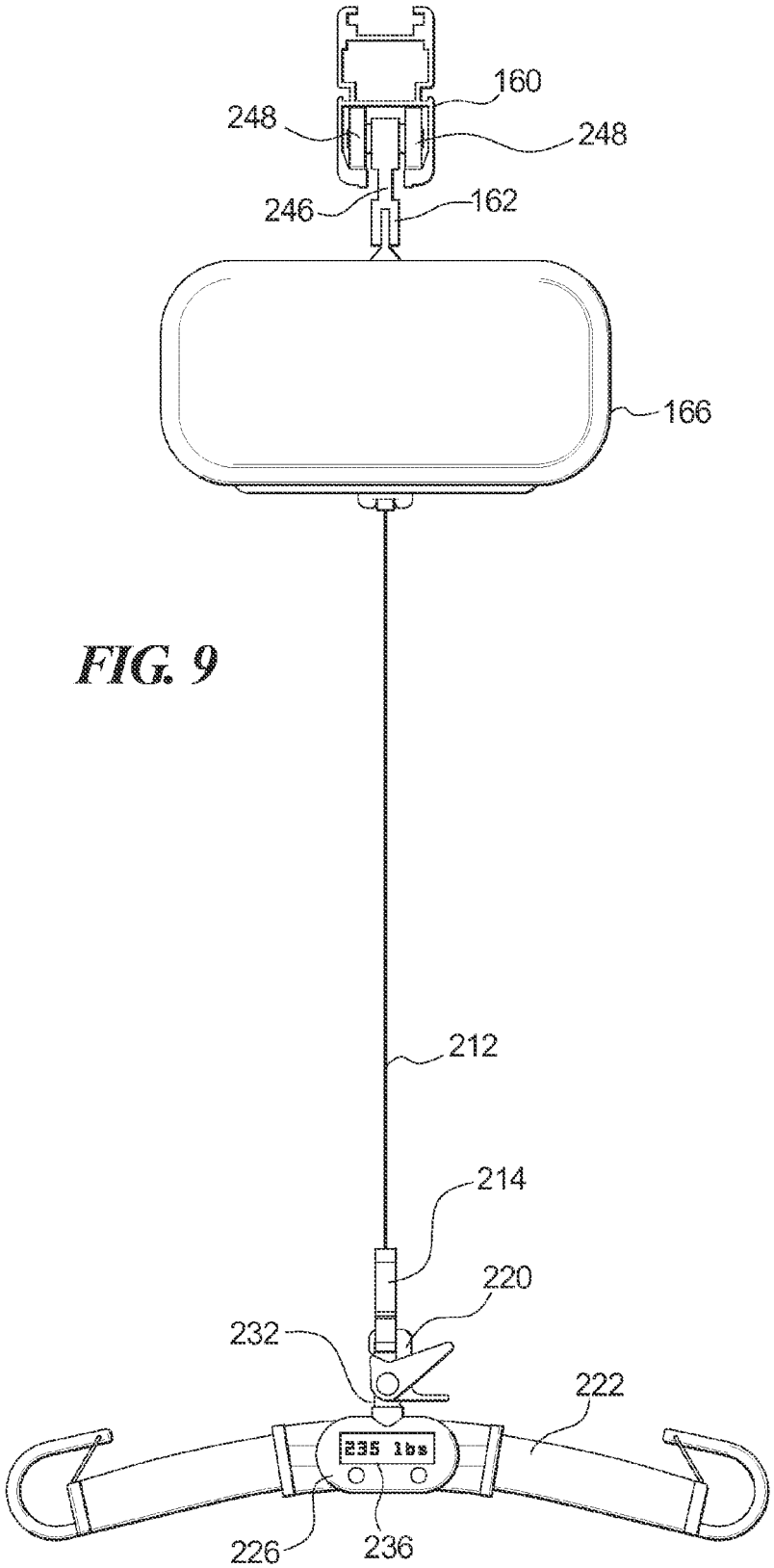
FIG. 9 is a front, elevational view of an embodiment of an overhead patient lift system and sling bar with an inductively charged integrated scale, of the present disclosure, showing the sling bar in a position at which it is not being inductively charged as a result of being spaced away from the inductive charging station in the lift apparatus.

FIG. 9 shows the sling bar 222 provided with a removable clip 220 that is attached to the D-ring 214 on the end of the lift strap 212. The lift strap 212 of the illustrated embodiment extends from the housing 166. The housing 166 encloses an electric motor and a drum on which the lift strap 212 is wound and from which the lift strap 212 is unwound for lowering and lifting the patient and for positioning the sling bar 222 for engaging the patient. The housing 166 has controls on it or more commonly is operated by a remote control for operation of the motor and drum. Electric power is provided to the housing 166 to power the motor and other components therein, including in certain embodiments an inductive charging station.

The sliding element 162 that connects the housing 166 to the beam 160 is seen in greater detail, including a central body 246 that extends from the housing 166 through a slot in the beam 160 and rollers 248 that ride in the beam 160. The rollers 248 enable the lift apparatus to be moved along the length of the beam 160, either while holding the patient or without the patient.

In the illustrated position of FIG. 9, the sling bar 222 and its inductive coil are out of range of the inductive coil in the housing 166. The scale 226 in the sling bar 222 operates by drawing power from a storage means, such as a battery or other power storage.

Figure 10:
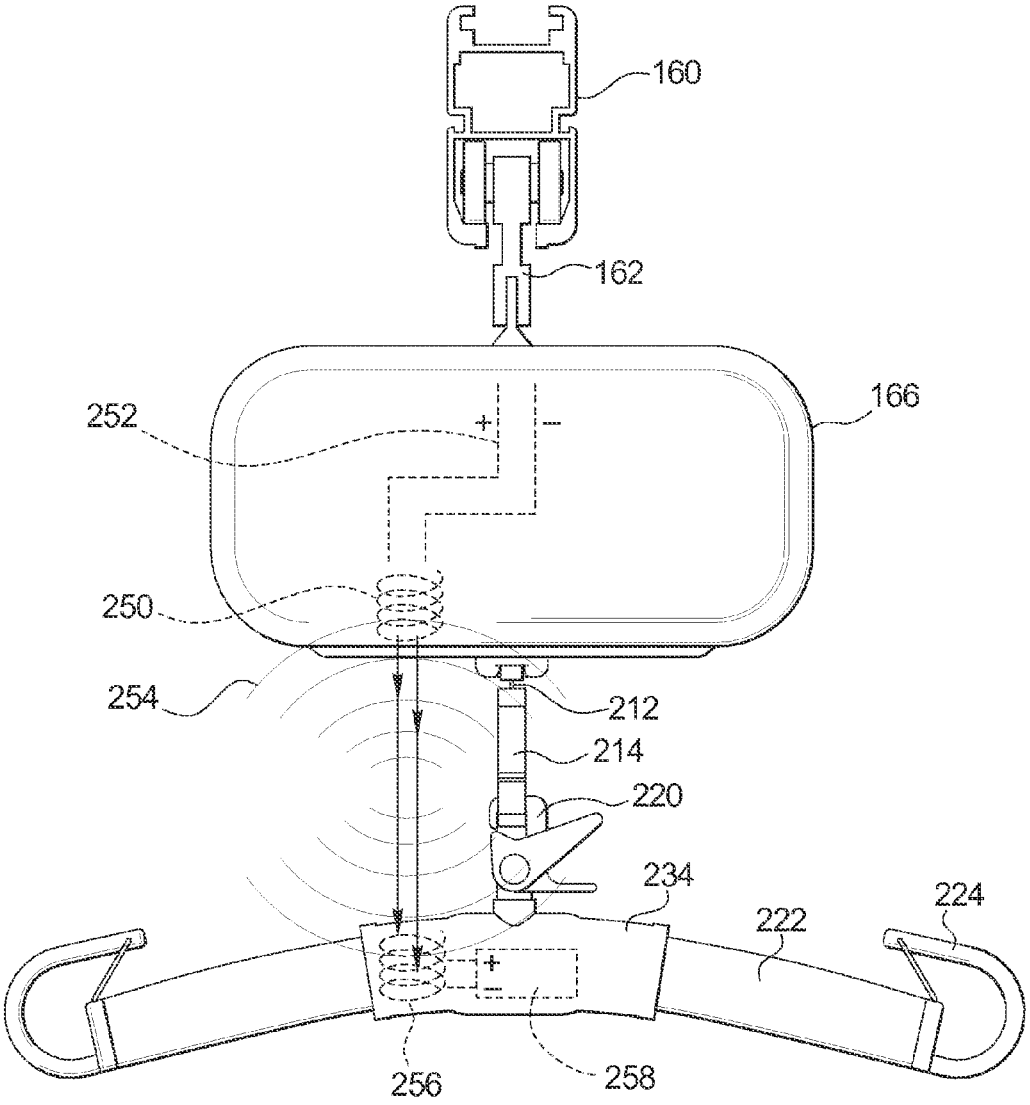
FIG. 10 is a front, elevational view of an embodiment of an overhead patient lift system and sling bar with an inductively charged integrated scale, of the present disclosure, showing the sling bar being inductively charged when it is positioned adjacent to the inductive charging station in the lift apparatus.

FIG. 10 shows the position of the housing 166 and sling bar 222 after the motor inside the housing 166 has been operated to retract the lift strap 212 into the housing 166. The housing 166 includes an inductive coil 250 connected to a power supply, indicated schematically at 252. The inductive coil 250 generates an electromagnetic field 254 that in certain embodiments is directed toward the sling bar 222. The sling bar 222, in addition to having the powered scale, also has an inductive coil 256 that is positioned in the sling bar 222 so as to be within power transfer range of the electromagnetic field 254 of the inductive coil 250 in the housing 166. Electrical power is transferred from the coil 250 to the coil 256. The electrical power received by the coil 256 is used by the scale 226 in the sling bar 222. In certain embodiments, the transferred electrical power is stored in a battery 258 that powers the scale, such as when the scale and coil 256 are out of power transfer range of the coil 250.

The sling bar 222 need not be removed for charging, but need only be retracted to a position adjacent the charging coil of the lift arm or lift motor, when power is being supplied to the charging coil.

Figure 11A:
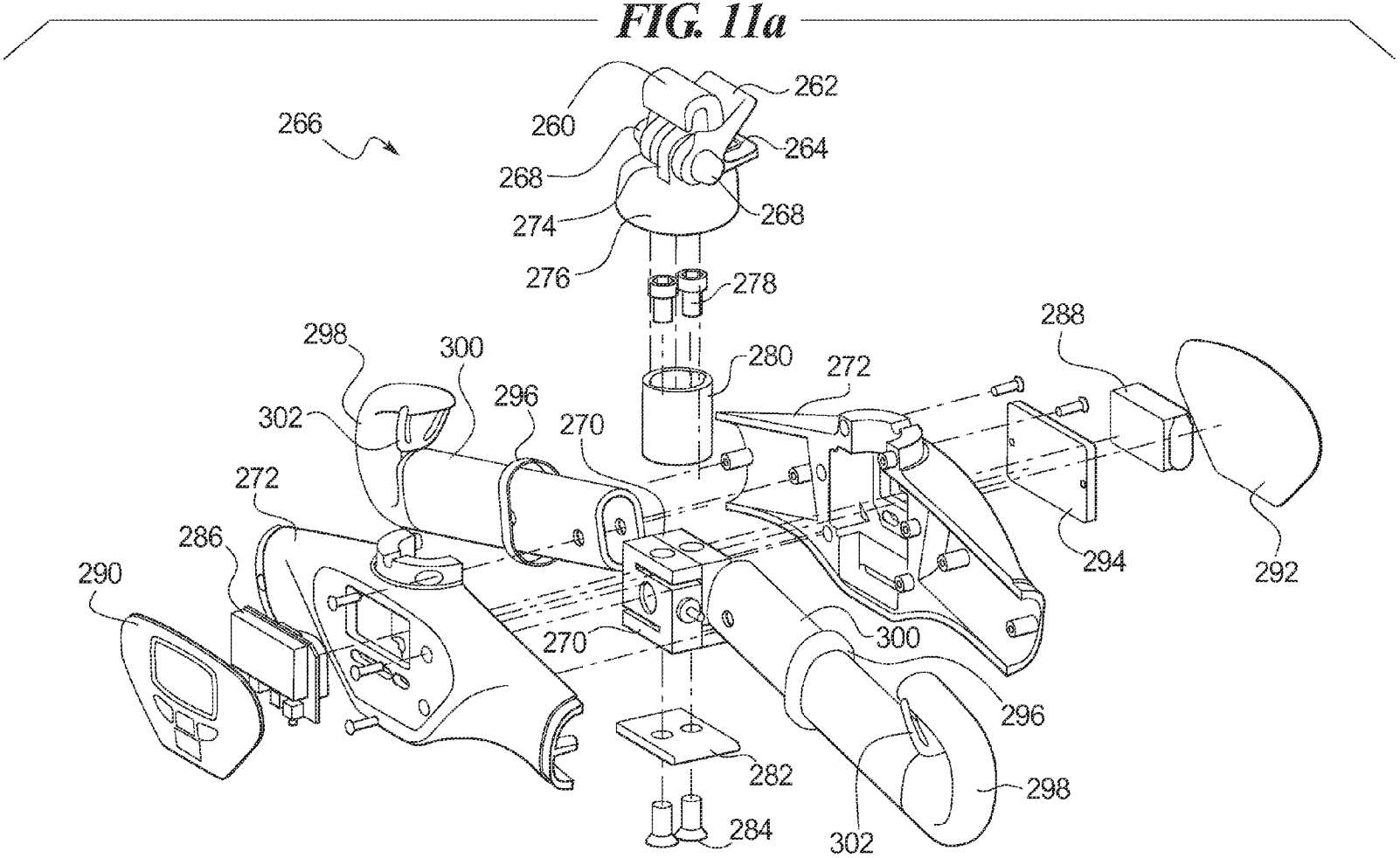
FIG. 11*a* is an exploded isometric view of an embodiment of a sling bar with an integrated scale having an electronic tilt compensation system, as disclosed herein.

FIG. 11*a* is an exploded view of a sling bar that includes a quick hook 260, a hook lock 262, and a quick hook spring 264 that operate together to permit attachment of the sling bar 266 to a D-ring. A cover cap 268 is disposed over ends of a pivot shaft that secures the quick hook 260 to a pivot attachment 274. The load cell of the illustrated sling bar includes two S beams 270 that are mounted to measure differences in tilt angle of the sling bar 266, for example, by being mounted back-to-back. An aluminum housing 272 (or other material housing) is provided in two parts and connects the weight carried by the sling bar 266 to the S beams 270. The pivot attachment 274 extends through a plastic cover 276 and is fastened an S beam upper bracket 280 that is secured to the tops of the two S beams 270 by screws 278. An S beam lower bracket 282 is attached to the bottoms of the two S beams 270 by screws 284. The lower bracket 282 transfers the weight of the sling bar 266 and its load to the S beams 270. Sensors such as strain gauges are mounted on the S beams to generate signals that correspond to the weight carried by the S beams 270.

An electronic scale 286 with an LCD screen is connected to receive the signals from the sensors on the S beams 270. A battery 288 provides power to the sensors and the scale 286. A screen keyboard 290 includes buttons to control the scale power and operation and is fastened to the housing by fasteners. A battery cover 292 is on the opposite side of the housing 272 from the screen keyboard 290. A battery bracket 294 mounts the battery within the housing 272. The sling bar itself includes two sling bar collars 296, two sling bars 300, and two composite hooks 298, each with a latch 302.

The S beams 270 are provided in two parts, in other words two S beams, that are mounted in opposite positions, rotated 180 degrees relative to one another and are positioned back-to-back. The S beams may be mounted mirror image reversed with respect to one another. The S beams are provided with sensors mounted on each so as to provide differential sensing when the sling bar is tilted. In other words, one of the sensors measures a greater weight and the other measures a lesser weight when the sling bar is tilted during weighing of a patient or other load. An algorithm in the scale 286 calculates and displays the true weight of the patient from the signals of the two sensors.

Figures 11B, 11C, 11D:
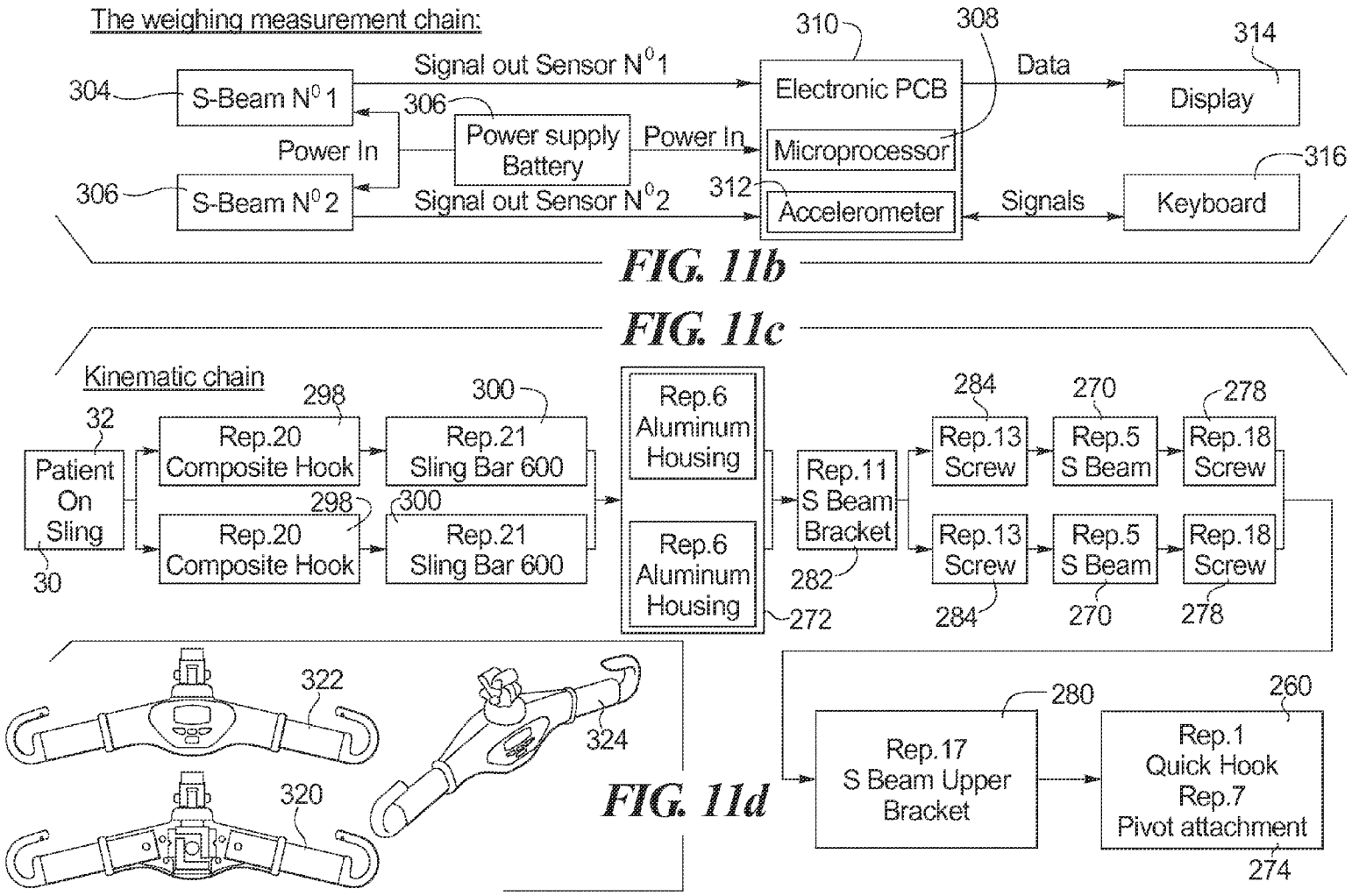
FIG. 11*b* is a block diagram of a measurement chain of the sling bar of FIG. 11*a*.
FIG. 11*c* is a block diagram of a kinematic chain of the sling bar of FIG. 11*a*.
FIG. 11*d* is a schematic representation of the sling bar of FIG. 11*a* showing tilt compensation.

A block diagram is shown in FIG. 11*b* that shows the weighing measurement chain. The two S beams each include a sensor 304 and 306, indicated as S beam sensor no. 1 and S beam sensor no. 2, that are provided with power via a power supply battery 306. The sensor output of the two sensors 304 and 306 is processed by a microprocessor 308 on a printed circuit board 310 that also includes an accelerometer 312. The weight of the load as determined by the processor 308 is displayed on the display 314. The keyboard 316 permits user control of the scale.

FIG. 11*c* shows the kinematic chain from the patient 32 on the sling 30 to the quick hook 260 that is fastened to the D-ring on the strap. The weight of the patient 32 is transmitted through the two S beams 270 to provide a weight measurement. The different weights sensed by the two S beams 270 are used by the processor in a calculation to obtain a true weight, for instance using a geometric calculation.

FIG. 11*d* compares side views of an outside of the sling bar to a cross section of the sling bar to illustrate measuring of a tilted load. In view 320, the sling arm may be tilted and the sensors of the two load cells, as seen in this interior view, may sense different weights. View 322 shows the outside of the sling bar and view 324 shows the sling bar in perspective.

Figure 12A:
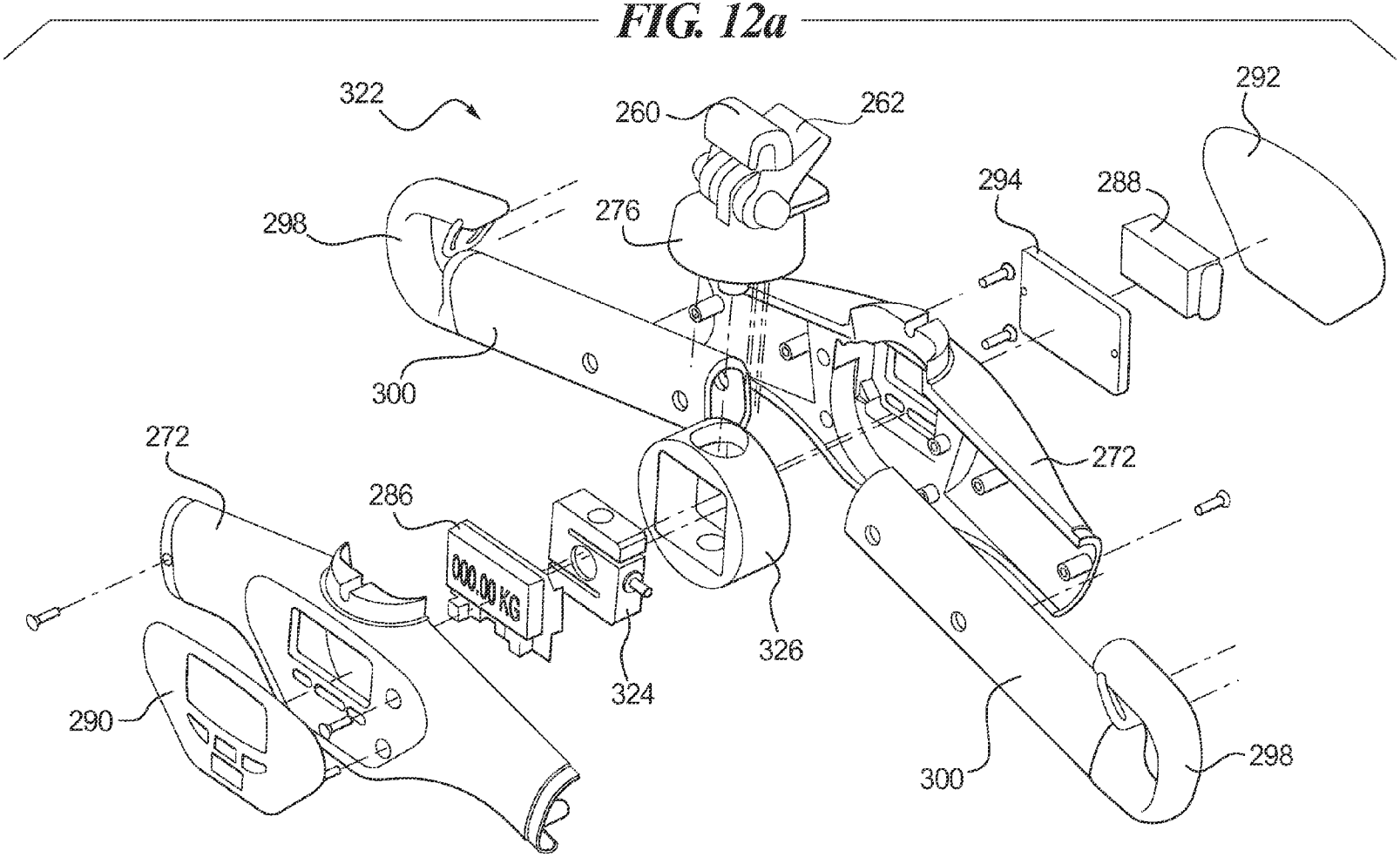
FIG. 12*a* is an exploded isometric view of an alternate embodiment of a sling bar with an integrated scale having an electronic tilt compensation system, as disclosed herein.

FIG. 12*a* is an exploded view of another embodiment of a sling bar 322 with an integrated scale. The sling bar has a load cell in for form of an S beam 324 mounted in a cylinder 326 that rotates relative to the sling bar so that the S beam 324 remains level even when the sling bar is tilted. The other components are similar to those of the embodiment shown in FIG. 11*a* and the same description may apply. The illustrated embodiment includes a quick hook, a hook lock, a quick hook spring, a quick hook release spacer, a cover cap, an aluminum housing, a pivot screw, a pivot attachment, a plastic cover, an electronic scale with an LCD screen, a battery, an S beam pivoting bracket, a screen keyboard, a plastic cover, screws, a battery bracket, a single S beam, a pair of composite hooks, a pair of sling bars, and a pair of latches. The S beam is provided in a cylindrical member that rotates to maintain a level position even if the sling bar tilts. An accurate weight is obtained no matter the tilt of the sling bar.

FIG. 12*b* shows that the sensor signal from the single S beam 324 is received by a microprocessor 308 on a printed circuit board 310 and the measured weight is displayed on the display 314.

FIG. 12*c* shows that the weight force of the patient 32 in the sling 30 is transmitted through the single S beam 324 for sensing the weight of the patient.

FIG. 12*d* compares a side view 346 of an outside of the sling bar to an interior view 348 of the sling bar when measuring a load with the sling bar level, and by comparison, the sling bar is measuring a tilted load in view 350. The view 350 shows the sling bar tilted but the S beam maintained in a non-tilted position as a result of the rotation of the cylindrical rotatable bracket that holds the load cell in the sling bar.

Figure 13A:
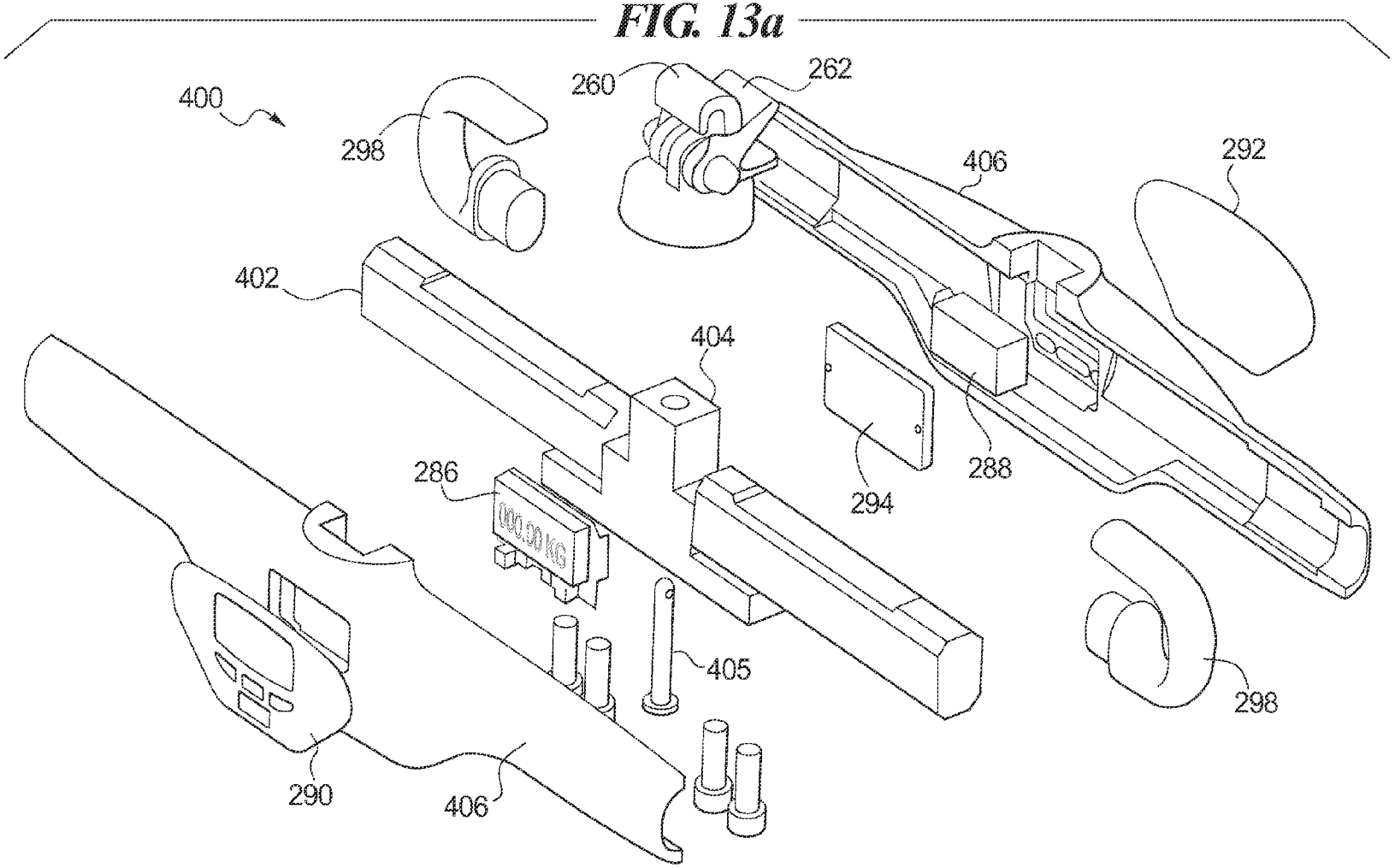
FIG. 13*a* is an exploded isometric view of an embodiment of a sling bar with an integrated scale that has a mechanical tilt compensation system integrated therein, which mechanical tilt compensation system prevents the load cell from tilting its load axis out of alignment with the vertical direction of gravitational force that is acting on the load cell, as disclosed in herein.

FIG. 13*a* shows an exploded view of a further embodiment having sensing for a tilted sling bar. The sling bar 400 includes a load cell in the form of two load beams 402 that extend from a central mounting 404 and that are each equipped with sensors. The signal of the two load beam sensors is received by the processor 308 and a processed to determine a true weight from the potentially different weights sensed by the two load beams 402 as a result of any tilting. The sling bar includes many of the same components already described herein and the same descriptions may apply. Included are a quick hook 260, a hook lock 262, a quick hook spring, a cover cap 276, a sling bar screw, a sling bar bolt R2R 405, two single point load beams 402, a load beam bracket 404, an aluminum housing 406, an electronic scale with and LCD screen, a screen keyboard, a plastic cover, two composite hooks, screws, a battery, a battery bracket and a plastic battery cover.

Figures 13B, 13C, 13D:
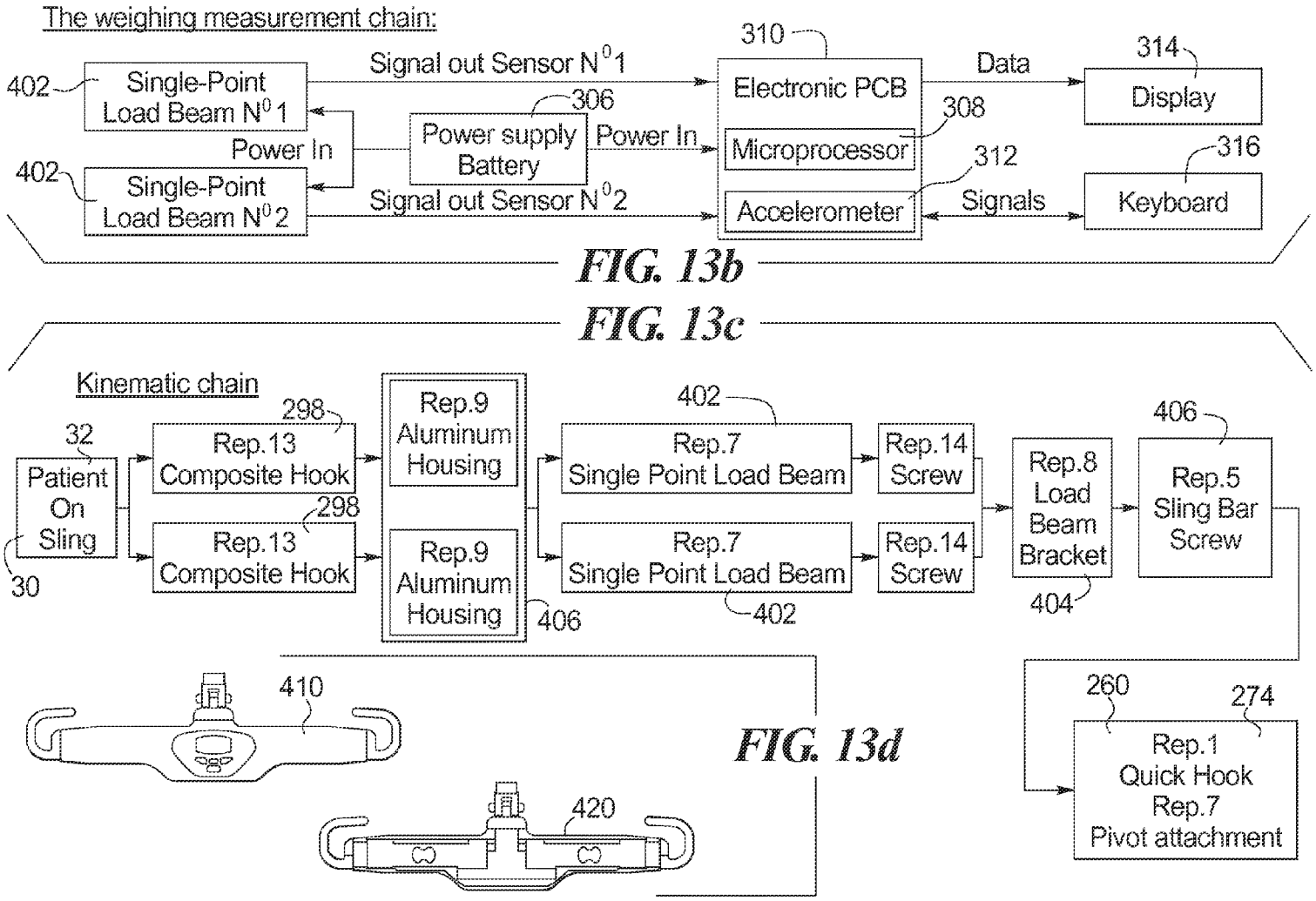
FIG. 13*b* is a block diagram of a measurement chain of the sling bar of FIG. 13*a*.
FIG. 13*c* is a block diagram of a kinematic chain of the sling bar of FIG. 13*a*.
FIG. 13*d* is a schematic representation of the sling bar of FIG. 13*a* showing tilt compensation.

FIG. 13*b* shows that the sensor signals from the two load beams 402 are received by a microprocessor 308 on a printed circuit board 310 for processing and the calculated weight is displayed on the display 314.

FIG. 13*c* shows that the weight force of the patient 32 in the sling 30 is transmitted through the two beams 402 for sensing the weight of the patient.

FIG. 13*d* compares side views of an outside 410 of the sling bar to a cross section 420 of the sling bar to illustrate measuring of a tilted load. View 420 shows that the two load cells may measure the weight of the load even when the sling bar is tilted by measuring different weights at the two ends.

Further features, including optional features, and operational aspects of the device are described below.

The power supply of certain embodiments is in electrical communication with the output display 236 as well as the load cell, for providing electrical power to both of the load cell and display 236. In certain embodiments, the scale 226 includes a processor and integrated program code capable of taking the output signal from the load cell under tension and calculating the weight of the tensile load that is being applied thereto. The processor then displays the calculated weight on the output display 236. However, in alternate embodiments, alternate load cell types, such as compression load cells or tension/compression load cells, may be used with either the same or different complimentary embodiments of a sling bar 222 without departing from the scope of the present disclosure. In addition, alternate load cell programming setups and configurations may be utilized herein without departing from the scope of the present disclosure.

In certain embodiments, the output display 236 is an LCD display that is configured to display the numerical weight of the active load suspended from the sling bar 222. However, in alternate embodiments, alternate display types, such as plasma, OLED, LED, or other such display types may be used without departing from the scope of the present disclosure.

In certain alternate embodiments, either of the quick-release link 110 with integrated scale or sling bar 222 with integrated scale includes wireless communication equipment and programming, such as equipment and programming for establishing a Wi-Fi or Bluetooth connection. The wireless communication equipment and programming may also be powered by the rechargeable batteries that power the scale. The wireless communications equipment is configured to transfer information, including at least patient weight data, to either the patient lift apparatus for further processing or directly to an Electronic Medical Record (EMR) system for accurate patient charting. In addition, the wireless communication equipment and programming is capable of recognizing, by the use of Radio Frequency Identification (RFID) tags worn by the patient, the identity of the patient who is being suspended from the patient lift and whose weight is being measured. That RFID information can then be used to access the correct patient EMR information for charting of the patient weight data to the correct EMR. RFID may also be used to identify and chart the specific sling or sling model being used to lift the patient.

In certain embodiments, the lift strap of the present disclosure is a flexible woven polyester lift strap that is wound up around and paid out from an outer surface of the lift drum of either the overhead lift apparatus or of a portable patient lift. In alternate embodiments, the strap may be made of woven nylon, woven steel fibers, or any other flexible woven polymer or other material capable of supporting an active lift load. Alternatively, the lift strap may be a polymer coated lift strap, or a flexible solid lift strap, as with a lift strap that is extruded as a flat strap.

In certain embodiments, the inductive charging station disposed in the lift apparatus is an electrically live coil of wire that is configured to charge a battery of a portable device, without making any electrical contact therewith. In certain embodiments of the overhead lift, the inductive charging station is a coil of wire disposed at or near a bottom side of the overhead lift apparatus. The coil of wire is positioned adjacent to the location where either the sling bar or quick-release link will rest when the quick-release link and sling bar are raised to or near a full lift height by taking up the lift strap with the lift apparatus. An electrical current is sent through the coil of wire to generate an electromagnetic field. When a second coil of wire that is part of an electrically closed loop is brought within the generated electromagnetic field, the field creates an electrical current in the second coil of wire. If the second coil of wire is connected to a rechargeable battery, for example in a portable device such as a scale integrated into the sling bar or the quick-release link of the lift system, the electromagnetic field will generate a current in the second coil of wire that is used to charge the portable devices rechargeable battery.

In certain embodiments, an inductive charging station may be included as part of a portable patient lift. In such embodiments, the inductive charging station is a coil of wire disposed at the free end of the patient lift arm. The coil of wire is generally positioned adjacent to where either of the sling bar or quick-release link will rest when attached to the lift arm. In alternate embodiments, a small boom may be affixed to the free end of the lift arm and extend laterally outward from the end thereof. The boom may be substantially parallel to either the sling bar connected to the free end of the lift arm or a quick-release link attached to the lift strap suspended from the end of lift arm. The coil of wire may be disposed at the end of such boom and otherwise positioned between the center of the sling bar and an end of the sling bar. Alternatively, the boom may be positioned to extend past the end of the lift arm, and/or slightly below the end of the lift arm, so as to be positioned adjacent to a quick-release link affixed to a lift strap suspended from the end of the lift arm An electrical current is sent through the coil of wire in the charging station to generate an electromagnetic field. When a second coil of wire that is part of an electrically closed loop is brought within the generated electromagnetic field, the field creates an electrical current in the second coil of wire. If the second coil of wire is connected to a rechargeable battery, for example in a portable device such as a scale integrated into the sling bar or the quick-release link of the lift system, the electromagnetic field will generate a current in the second coil of wire that is used to charge the portable device's rechargeable batteries.

Embodiments that include tilt compensation may be provided. Many tension load cells have a "load axis," which is often defined as an axis passing through the two set loading points of the load cell through which an active load is applied. In order for a tension load cell to provide accurate measurements, the load cell must be oriented such that the load axis is parallel to the direction of the force being applied to the load cell. Thus, in order to properly measure the weight of active loads freely suspended from the sling bar, the load cell must be oriented during active measurements such that its load axis is perpendicular to ground (i.e. vertical) so as to be aligned with the vertical gravitational forces being imparted by the suspended load.

Ideally, when an active load is suspended beneath a sling bar, the load is distributed evenly along the length of the sling bar so that the sling bar maintains a horizontally balanced position about its center point. In embodiments of a lift system as disclosed herein that utilize a sling bar having an integrated scale, the load cell of the integrated scale may also be located at the center point of the sling bar and oriented so that, when the sling bar is properly balanced in a horizontal position about its center point, the load axis of the load cell is vertical and otherwise parallel with the direction of gravitational force. This vertical orientation of the load axis, in a direction parallel to gravitational force, is necessary to ensure proper weight measurement by the load cell.

However, if the active load suspended from the sling bar is not properly balanced or centered below the sling bar, the unbalanced weight may cause the sling bar, and accordingly the load cell disposed therein, to tilt at an angle from its normal balanced position. This means that the load axis would become tilted or angled at some angle to the vertical direction of gravitational force, resulting in errors in the accuracy of any measurements taken by the load cell while in that position. Accordingly, there are further disclosed herein embodiments of a sling bar having an integrated scale that either prevent the load axis from tilting out of alignment with the vertical direction of gravitational force, or compensate for situations when the load axis tilts at some angle away from vertical while measuring the forces on the load cell.

In certain embodiments of the sling bar with integrated scale, the scale utilizes two "S" shaped load cells stacked together, one in front of the other with the rearward positioned load cell being flipped over (front to back) relative to the frontward positioned load cell. An "S" shaped load cell is a load cell having the physical shape of the letter "S" that functions as a tension load cell with its load axis passing through the vertical center of each leg of the "S" shaped cell. In this embodiment, each "S" shaped load cell has a front face ("S" shaped when facing an observer) and a back face (backward "S" shaped when facing an observer). The two "S" shaped load cells are stacked so that either the two front faces are mated to each other, or the two back faces are mated to each other. Thus, when viewing the stacked "S" shaped load cells stacked together from either of the front or back side, one of the load cells is rotated 180-degrees about its load axis relative to the other load cell. The opposing stacked configuration of the load cells ensures that no unwanted deflections in the load cell bodies occur that would affect the accuracy of the measurements taken by the load cells. Because the active load is not being applied in a direction parallel to the load axes, the load cells do not register the full weight of the active load, and indeed typically measure the weight as being less than the actual weight of the active load. However, knowing the tilt angle of the load cells and their load axes permits the calculation of the full accurate weight of the active load. Thus, the integrated scale of certain embodiments also utilizes an integrated accelerometer or gyroscope to determine the angle of the load axes of the two load cells relative to the vertical gravitational axis. With the tilt angle of the load cells (and the sling bar) measured by the accelerometer, and accurate force measurements taken by the load cells, the scale (or a processor in communication with the scale) is then able utilize programming to perform vector physics calculations to determine the accurate total weight of the active load acting on the load cells. In this manner, the tilt angle may be electronically compensated for and accurate measurements of the total weight of the active load may be determined.

In yet other embodiments of a sling bar with integrated scale employing tilt compensation mechanisms and methods, the sling bar may have a central load beam bracket disposed at the center of the sling bar. Two load cells in the form of single-point load beams are affixed to the central bracket, one each attached to opposing sides of the bracket an extending horizontally outward therefrom to form the arms of the sling bar. An outer housing surrounds the central bracket and coupled load beams, with the lift hooks that carry the load disposed in either the ends of the housing or coupled to the ends of the load beams. In use, the top of the central bracket gets coupled to the lift strap or the lift arm of the lift system, and active loads placed on the lift hooks at the ends of the sling bar cause deflection of the load cells. To accurately measure the gravitational forces of an active load suspended form the sling bar that cause deflection of the load cells, and thus calculate accurate weight measurements of the active load, the sling bar must be balanced in a horizontal position so that the load cells are positioned parallel to ground (perpendicular to the vertical direction of the gravitational forces). If the sling bar becomes tilted at some angle to the vertical due to unbalanced loads, the direction of gravitational force will no longer be perpendicular to the load cells. One of the load cells will have gravitational force acting on its end at some angle greater than 90-degrees relative to the length of the load cell, and the opposite load cell will have gravitational forces acting on its end at an less than 90-degrees. With the sling bar tilted, each load cell will register a force thereon of less than its share of the actual gravitational force acting on the active load. This would result in inaccurate weight calculation of the active load. Accordingly, as with the above embodiment, to compensate for the tilt angle and ensure accurate weight calculations, an accelerometer is disposed within the sling bar to ascertain the tilt angle of the sling bar as it deviates from the horizontal position. Once tilt angle is measured by the accelerometer, the scale (or a processor in communication with the scale) is then able use the tilt angle and the forces measured by the load cells as input for programming that will perform vector physics calculations, or run some other similar electronic compensation algorithm, to determine the accurate total weight of the active load acting on the load cells.

In still other embodiment, the load cell, for example an "S" shaped load cell, may include mechanical tilt compensation, by which the load cell would be prevented from having its load axis tilt at an angle from the vertical direction of gravitational force when an active load is placed on the sling bar, regardless of whether the load is balanced or unbalanced. In such embodiments, the load cell is mated into the interior of a cylindrical bushing or bearing member that is disposed within the sling bar, around which bushing or bearing member the housing (or cross bar) of the sling bar is free to rotate. An upper end of the load cell is coupled to a structure that is mated to the lift strap or lift arm of a lift system, while a lower end of the load cell is coupled to the bushing or bearing member. In this manner, any active loads placed on the sling bar that are unbalanced, or otherwise cause the sling bar to tilt form its balanced horizontal position, result in the housing (or cross bar) of the sling bar rotating freely around the outer cylindrical surface of the bushing or bearing member while the load cell remains in a single vertical position in which the load axis of the load cell is always maintained in a vertical position parallel with the gravitational direction, similar to a gimbal. While the aforementioned embodiment disclosed the bushing or bearing member as being a cylindrical member, in alternate embodiments the bushing or bearing member may also be a sphere, a spherical shell, or employ geometric configurations in which the bushing member or apparatus has one or more axes of rotation around which the sling bar may rotate, without departing from the scope of the present disclosure.

In any of the above embodiments additional equipment such as accelerometers or gyroscopes for determining the position of the sling bar, as previously disclosed herein may be included within the interior of the sling bar and powered by the rechargeable batteries. As with the RFID information, such positional information may be wirelessly sent to the patient's EMR for charting or it may be used to provide feedback to the lift apparatus for further processing. In addition, the sling bars with an integrated scale may be configured such that the cross bar is not a single unitary cross bar running the full length of the sling bar, but is rather broken up into two separate arms, one on each side of the housing that are selectively detachable from the housing. In such embodiments, the housing may include quick-disconnect connectors where the housing connects to the arms of the sling bar to permit the arms to be quickly and easily removed from, and replaced into, the housing. In alternative embodiments, alternate fasteners, such as removable screws or other mechanical fasteners, may be used to join the arms of the sling bar to the housing, without departing from the scope of the present disclosure. In this manner, with removable arms, arms of differing length may be utilized with the housing to accommodate different lift conditions, sling styles, patient sizes, or any other condition necessitating arm lengths of adjustable sizes.

Referring to the figures and specifically to FIG. 5, certain embodiments of the overhead motorized lift system of the present disclosure including a sling bar with an integrated scale operates as follows. To weigh a patient using the lift system and sling bar of the present disclosure, the sling bar with integrated scale is connected about a center quick-connect hook or alternate connector structure to the free end of a lift strap extending downward from the patient lift apparatus. The center hook or connector is coupled to the top connector of the scale's load cell, while the bottom connector of the load cell is coupled to the structure of the cross bar. With the sling bar at rest, but suspended from the lift strap, the power button on the integrated scale is depressed to turn on the scale. A patient sling is connected by its lift loops to the lift hooks at the ends of the sling bar, and a user, such as a care giver, uses a handheld remote control to direct the lift apparatus to take up the lift strap and raise the sling so that it is only supported by the sling bar. The load cell is accordingly measuring the weight of the empty sling, which needs to be accounted for in determining the patient weight. Therefore, the "zero" button is depressed to re-zero the scale and remove the weight of the suspended sling from the patient weight measurement.

The sling is then removed from the sling bar and positioned beneath a patient seated in a chair or on a patient bed. The sling is re-connected by its lift loops to the lift hooks disposed at the ends of the sling bar. The caregiver again controls the lift apparatus to take up the lift strap, raise the sling bar and sling that is supported on the lift hooks of the sling bar, and raise the patient seated in the sling off of the chair, bed, or ground so that the patient is suspended from and supported by only the sling. The load cell of the integrated scale is thus placed into tension by the application of the gravitational force of the patient, sling, and sling bar pulling downward on the load cell's bottom connector affixed to the cross bar, and the opposing force from the lift strap pulling upward on the top connector of the load cell. With the weight of the patient placing the load cell in tension, the patient's weight on the load cell is thus calculated by the scale, or a processor in communication with the scale or load cell of the scale, and displayed for the caregiver on the output display of the scale.

When the sling bar becomes tilted under an active load that is not evenly balanced on the sling bar, a gyroscope or accelerometer may measure the tilt angle of the sling bar while the load cells in the scale measure the gravitational force of the active load on the angled load cell. The force measured by a tilted load cell will typically be less than the actual force being applied thereto, because the force is being applied to the tilted load cell at an angle to the load axis, rather than parallel to the load axis. Thus, to calculate the real weight of the load on the sling bar, both the tilt angle measured by the accelerometer and the force measured by the load cell may be used as input values by programming or software stored in the scale, or in a processor in communication with the scale, that calculates, or runs an algorithm that calculates, the accurate weight of the active load suspended from the sling bar, such as the weight of a patient.

The patient weight data can optionally be transmitted by onboard communications equipment in the sling bar to either a patient EMR for charting or to the lift apparatus for further processing. When the sling bar is not in use for moving or weighing a patient, the patient sling is removed from the lift hooks of the sling bar and the lift apparatus is operated to take up the full length of the lift strap, such that the sling bar is positioned immediately below the lift apparatus.

In embodiments utilizing an inductively charged power supply to power the scale, for one embodiment, when a predetermined length of the lift strap is taken up by the lift apparatus, such that the sling bar is at or below a predetermined distance from the lift apparatus, power may be automatically supplied to the inductive charging station disposed therein. In an alternate embodiment, the lift apparatus is configured to require the full length of the lift strap be taken up before power is automatically supplied to the inductive charging station. In still a further alternate embodiment, the power may only be supplied to the primary coil in the inductive charging station when a power switch is manually turned on by an operator of the lift apparatus. In yet another embodiment, the power to the charging station may always be turned on, regardless of the position of the sling bar.

The power supplied to the primary charging coil within the charging station creates an electrical current in the primary charging coil, which in turn generates an electromagnetic field around the primary coil. The secondary inductive coil disposed within the cross bar of the sling bar is connected to the terminals of the rechargeable battery of the integrated scale. When the sling bar is raised so that the secondary charging coil is brought within the electromagnetic field, an electrical current is generated within the secondary coil by the electromagnetic field. The generated electrical current in the secondary coil charges the rechargeable battery. In this manner, recharging of the batteries for the scale is accomplished through inductive charging. Accordingly, there need not be any physical or electrical connection between the primary and secondary coils, or between the power supply for the primary coil and the rechargeable batteries, in order to recharge the batteries of the integrated scale.

In one embodiment, the primary coil and the secondary coil are respectively positioned within the lift apparatus and sling bar such that, when the sling bar is fully raised, the primary coil is positioned directly above the secondary coil, or otherwise positioned as close as possible to each other so as to achieve maximum efficiency in the inductive charging. In one embodiment, the secondary coil is located down the length of the cross bar between the integrated scale and the lift hook at the end of the cross bar. The primary coil would thus be positioned at a bottom surface of the housing of the lift apparatus, directly above the location of the secondary coil on the sling bar.

In one embodiment, when the lift apparatus is next needed for further use, the lift strap is paid out from the lift apparatus, and the power to the primary coil in the charging station is automatically turned off when the sling bar reaches a certain distance away from the charging station. In alternate embodiments, the power may be manually turned off by an operator of the lift.

The above described operation is for embodiments operating with a motorized overhead lift apparatus having a lift strap that is paid out or taken up therefrom. In alternate embodiments, the system and sling bar with an integrated scale may be used with portable lifts. In such embodiments, the sling bar may be connected either to a lift strap that can be paid out or taken up from the end of the lift arm, or directly to the end of the lift arm without the use of a lift strap. For embodiments of the portable patient lift utilizing an inductively charged power source to power the integrated scale, a primary inductive charging coil may be disposed at the end of the lift arm, or at the end of a boom extending laterally from the end of the lift arm. As previously discussed for various embodiments, the primary inductive coil and the secondary coil may be positioned such that they are as close as possible to each other. Unlike embodiments utilizing a lift strap, for those embodiments where the sling bar is coupled directly to the lift arm, because the position between the end of the lift arm and the sling bar is constant during use, the power to the primary coil may be continuous power such that the rechargeable battery for the scale is continuously being recharged, even during normal use of the portable lift. In alternate embodiments, the power to the primary inductive charging coil may be selectively turned off or on by an operator of the portable lift.

Providing the ability to maintain a portable and inductively rechargeable battery directly within the sling bar, so as to provide power to the patient scale as well as other onboard equipment, simplifies the management of the electronics within the sling bar. The continuous rechargeable power supply at least eliminates the need to change batteries, which would otherwise result in total loss of power to the equipment on the sling bar.

In addition, providing a sling bar that includes a patient scale integrated within the frame of the sling bar or the quick-release link at the end of a lift strap eliminates the need for in-line equipment connected between the lift strap and the sling bar. This in turn reduces the distance between the sling bar and the lift strap and increases the available lift height for the patient suspended from a patient sling, as compared to lift setups that must use an in-line scale where up to 8 inches of lifting height may be lost. This is particularly important in rooms having low ceiling heights and an installed overhead lift.

Furthermore, integrating the scale into the quick-release link or sling bar makes a display that is additionally integrated therein highly readable, since the quick release link or sling bar will be positioned close to the caregiver's field of view. In addition, the sling bar with an inductively charged integrated scale may be used with existing lift systems by retrofitting the lift apparatus with an induction charger, so that completely new lift systems are not required to put the sling bar into use.

In addition, there are beneficial therapeutic uses associated with a quick-release link or sling bar having an integrated scale disposed therein. For example, for some patient types who have experienced a loss or decrease in their ability to walk and are attempting to regain or improve such ability, such as for example bariatric patients, geriatric patients, patients involved in accidents, or patients who have undergone major surgical procedures to the back or lower extremities, the lift system with integrated scale may become an integral part of a patient's walking re-education program. The system and integrated scale is a useful tool to help physiotherapists re-educate such patient types when they are learning how to walk again on a treadmill positioned beneath the patient lift.

For example, the physiotherapist may utilize the integrated scale to first determine the patient's total weight, which may be entered and tracked in the patient's EMR. The physiotherapist may then, as part of the re-education program, have the patient walk on a treadmill while some or all of the patient's weight is supported by the patient lift having an integrated scale in the sling bar or quick-release link. The physiotherapist may then take weight readings from the integrated scale while the patient is being partially supported by the lift when walking on the treadmill during the re-education therapy. Alternatively, the integrated scale may send periodic real time weight measurements to the patient's EMR. The integrated scale, or a processor in communication with either the integrated scale or the patient's EMR, may then compare the patient's full weight measurement to the periodic weight measurements taken during walking re-education therapy to calculate what percentage or proportion of the patient's total weight is being supported by the patient (or conversely by the patient lift) during therapy. In this manner, the physiotherapist may track patient progress by showing whether, over time and with continued therapy, the patient is increasing his ability to support an increasing percentage or amount of his own body weight while walking, with the goal being that the patient will eventually be able to fully walk on his own without the need for the overhead lift to support any of the patient's weight.

Various embodiments have been described hereinafter with reference to the accompanying drawings, which form a part hereof, and which show, by way of illustration, specific embodiments. However, this invention may be embodied in many different forms and should not be construed as limited to the embodiments set forth herein. Rather, these embodiments are provided so that this disclosure will be thorough and complete, and will fully convey the scope of the invention to those skilled in the art. The detailed description is not to be taken in a limiting sense.

Throughout the specification and claims, the following terms take the meanings explicitly associated herein, unless the context clearly dictates otherwise. The phrase "in one embodiment" does not necessarily refer to the same embodiment, although it may. Furthermore, the phrase "in another embodiment" does not necessarily refer to a different embodiment, although it may. Thus, as described below, various embodiments may be readily combined without departing from the scope or spirit of the present disclosure.

In addition, as used herein, the term "or" is an inclusive "or" operator, and is equivalent to the term "and/or," unless the context clearly dictates otherwise. The term "based on" is not exclusive and allows for being based on additional factors not described, unless the context clearly dictates otherwise. In addition, throughout the specification, the meaning of "a," "an," and "the" include plural references. The meaning of "in" includes "in" and "on".

Although other modifications and changes may be suggested by those skilled in the art, it is the intention of the inventors to embody within the patent warranted hereon all changes and modifications as reasonably and properly come within the scope of their contribution to the art.

What is claimed is:

1. A patient lift system, comprising:

a lift apparatus including a first portion of an inductive charging system;

a lift strap having a first end and a second end, the first end of the lift strap being connected to the lift apparatus;

a sling bar connected to the second end of the lift strap, said sling bar having a second portion of the inductive charging system, the inductive charging system being operable to inductively transmit power from the first portion to the second portion;

a load cell and sensor mounted at the sling bar, the load cell and sensor being configured and operable to measure a load on the sling bar regardless of a tilt angle of the sling bar from horizontal;

a processor connected to the sensor and being configured and operable to calculate a weight of an active load suspended from the sling bar, the weight calculation determining a weight of a load suspended from the sling bar from a measured force by the sensor regardless of tilt angle of the sling bar;

a scale in the sling bar for outputting the weight determined by the processor; and a power source in the sling bar in electrical communication with the scale to provide power to the scale, the power source being connected to receive the inductively transmitted power from the second portion.

2. A patient lift system, comprising:

a lift apparatus;

a lift strap having a first end and a second end, the first end of the lift strap being connected to the lift apparatus;

a sling bar connected to the second end of the lift strap, said sling bar having a scale integrally disposed in the sling bar for measuring forces applied to the scale, and a power source in electrical communication with the scale to provide power to the scale;

a load cell and sensor mounted at the sling bar, the sensor and load cell being configured and operable to measure a load on the sling bar regardless of a tilt angle of the sling bar from horizontal; and a processor connected to the sensor and being configured and operable to calculate a weight of an active load suspended from the sling bar, the weight calculation determining a weight of a load suspended from the sling bar from a measured force by the sensor regardless of tilt angle of the sling bar;

an inductive charging system including a first portion in the lift apparatus and a second portion in the sling bar, the second portion being connected to the power source to provide power to the scale, the first and second portions being operable to inductively transmit power from the first portion to the second portion.

3. A patient lift system as claimed in claim 2, further comprising:

a movable base including legs and an upright frame on which the lift apparatus is supported.

4. A patient lift system as claimed in claim 2, further comprising:

a beam and sliding element configured for connection to a structural element of a building, the beam and sliding element being connected to support the lift apparatus.

5. A patient lift system as claimed in claim 2, wherein the lift apparatus includes a housing enclosing a motor and drum, the first end of the lift strap being mounted on the drum and the motor being operable to selectively retract and selectively pay out the lift strap.

6. A patient lift system as claimed in claim 2, wherein the load cell includes two load sensing elements mounted in the sling bar and connected the processor, the two load sending elements providing sensor data to the processor by which the processor performs the calculation.

7. A patient lift system as claimed in claim 6, wherein the two load sensing elements include two load cells extending in opposite directions from a center of the sling bar.

8. A patient lift system as claimed in claim 6, wherein the two load sensing elements include two load cells mounted back-to-back and oriented approximately 180 degrees relative to one another.

9. A patient lift system, comprising:

a lift apparatus;

a lift strap having a first end and a second end, the first end of the lift strap being connected to the lift apparatus;

a sling bar connected to the second end of the lift strap, said sling bar having a scale integrally disposed in the sling bar for measuring forces applied to the scale, and a power source in electrical communication with the scale to provide power to the scale;

a load cell and sensor mounted at the sling bar, the sensor and load cell being configured and operable to measure a load on the sling bar regardless of a tilt angle of the sling bar from horizontal;

a processor connected to the sensor and being configured and operable to calculate a weight of an active load suspended from the sling bar, the weight calculation determining a weight of a load suspended from the sling bar from a measured force by the sensor regardless of tilt angle of the sling bar, the processor performing one of a geometric calculation or a vector calculation to obtain a total weight; and a rotatable housing having a horizontal axis of rotation, the rotatable housing including a cylinder mounted without a cylindrical opening in the sling bar, the load cell and sensor being mounted in the cylinder, the rotatable housing being operable to maintain the load cell and sensor in a position to sense a weight of the sling bar along a direction of gravitational force when the sling bar is tilted from horizontal.

10. A patient lift system, comprising:

a lift apparatus;

a lift strap having a first and a second end, said lift strap connected at said first end to said lift apparatus;

a quick-release link connected to said second end of said lift strap for supporting an active load therefrom, said quick-release link having a scale and a load cell adjacent to the quick release link, the scale and the load cell being operable to measure forces applied to the load cell, a power source in electrical communication with said scale to provide power to said scale and load cell; and an inductive charging system including a first portion in the lift apparatus and a second portion in the quick release link, the second portion being connected to the power source to provide power to the scale, the first and second portions being operable to inductively transmit power from the first portion to the second portion.

11. A patient lift system as claimed in claim 10, wherein the load cell includes a first end and a second end, the first end of the load cell includes a lift strap retention buckle connected to the lift strap.

12. A patient lift system as claimed in claim 11, wherein the load cell is generally C-shaped.

13. A patient lift system as claimed in claim 10, wherein the quick release link includes a D-ring configured to connect to a sling bar.

14. A patient lift system, comprising:

a lift apparatus;

a lift strap having a first end and a second end, the first end of the lift strap being connected to the lift apparatus;

a sling bar connected to be suspended from to the second end of the lift strap;

a load cell disposed to measure forces exerted by a load suspended from the sling bar;

a scale connected to the load cell and operable to indicate a weight of the load suspended from the sling bar;

a power source connected to power the load cell and the scale;

wherein the load cell and the scale and the sensor are in one of:

the sling bar, or a connector link between the lift strap and the sling bar, and an inductive charging system including a first portion in the lift apparatus and a second portion in the one of the sling bar or the connector link, the second portion being connected to the power source to provide power to the scale, the first and second portions being operable to inductively transmit power from the first portion to the second portion.

15. A patient lift system as claimed in claim 14, further comprising:

a movable base including legs and an upright frame on which the lift apparatus is supported.

16. A patient lift system as claimed in claim 14, further comprising:

a beam and sliding element configured for connection to a structural element of a building, the beam and sliding element being connected to support the lift apparatus.

* * * * *